US009305416B2

(12) United States Patent
Matsuura et al.

(10) Patent No.: US 9,305,416 B2
(45) **Date of Patent: *Apr. 5, 2016**

(54) BANKNOTE RECOGNITION AND COUNTING MACHINE AND BANKNOTE RECOGNITION AND COUNTING METHOD

(71) Applicant: GLORY LTD., Himeji-Shi, Hyogo-Ken (JP)

(72) Inventors: Shinji Matsuura, Tokyo-To (JP); Hajime Morino, Kasukabe (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/459,574

(22) Filed: Aug. 14, 2014

(65) Prior Publication Data

US 2014/0346093 A1 Nov. 27, 2014

Related U.S. Application Data

(63) Continuation of application No. 13/256,938, filed on Sep. 16, 2011, now Pat. No. 8,818,071.

(51) Int. Cl.
*G07D 11/00* (2006.01)
*G07D 7/00* (2006.01)

(52) U.S. Cl.
CPC ..... *G07D 11/0084* (2013.01); *G07D 7/00* (2013.01)

(58) Field of Classification Search
None
See application file for complete search history.

(56) References Cited

U.S. PATENT DOCUMENTS

| | | | | |
|---|---|---|---|---|
| 8,818,071 | B2 * | 8/2014 | Matsuura et al. | 382/135 |
| 2003/0168849 | A1 * | 9/2003 | Reinisch | 283/72 |
| 2004/0026498 | A1 * | 2/2004 | Fujioka | 235/379 |
| 2005/0006458 | A1 * | 1/2005 | Wanibe et al. | 235/379 |
| 2009/0166269 | A1 * | 7/2009 | Tanaka | G07D 11/0084 209/534 |
| 2012/0041590 | A1 * | 2/2012 | Ozaki | G07D 11/0063 700/214 |

* cited by examiner

*Primary Examiner* — Jon Chang
(74) *Attorney, Agent, or Firm* — Renner, Kenner, Greive, Bobak, Taylor & Weber

(57) ABSTRACT

Banknotes are taken into a banknote recognition and counting machine (10), a recognition and counting process for the banknotes is performed by a recognition and counting unit (24), judgment for the banknotes is performed by using a first judgment threshold value, based on the recognition result on each banknote recognized by the recognition and counting unit (24), and then the banknotes are fed, selectively, to a stacking unit (26) or reject unit (30), based on the judgment result on each banknote. Then the banknotes, respectively fed to the reject unit (30), are taken again into the banknote recognition and counting machine (10), the recognition and counting process for such banknotes is performed by the recognition and counting unit (24), and then the judgment for the banknotes is performed, by using a second judgment threshold value set smaller than the first judgment threshold value, based on the recognition result on each banknote recognized by the recognition and counting unit (24). Thereafter, information, which relates to the total sum of a count result on the banknotes, respectively judged to be true upon the judgment for the banknotes by using the first judgment threshold value and another count result on the banknotes, respectively judged to be true upon the judgment for the banknotes by using the second judgment threshold value, is output.

11 Claims, 10 Drawing Sheets

| | | NORMAL COUNTING MODE | RELAXATION COUNTING MODE | |
|---|---|---|---|---|
| | | FIRST JUDGMENT THRESHOLD VALUE | SECOND JUDGMENT THRESHOLD VALUE | |
| | | ALL MODES | DIFFERENT DENOMINATION MODE OR MIXED-DENOMINATION DEPOSIT MODE | MODE OTHER THAN THE MODES DESCRIBED ON THE LEFT SIDE |
| DENOMI-NATION JUDGMENT | IR1 | 50 | 0 | 25 |
| | IR2 | 80 | 0 | 40 |
| | MG1 | 60 | 0 | 30 |
| AUTHEN-TICITY JUDGMENT | IR1 | 256 | 0 | 128 |
| | IR2 | 341 | 0 | 170 |
| | MG1 | 280 | 0 | 140 |

FIG. 7

(a)

| | |
|---|---|
| NORMAL COUNTING MODE | $1,153 |
| RELAXATION COUNTING MODE | $ 6 |
| TOTAL | $1,159 |

(b)

DEPOSIT

STATEMENT

| | | | |
|---|---|---|---|
| $ 1 | X | 4 | (BANKNOTES) |
| $ 2 | X | 10 | (BANKNOTES) |
| $ 5 | X | 3 | (BANKNOTES) |
| $ 10 | X | 20 | (BANKNOTES) |
| $ 20 | X | 11 | (BANKNOTES) |
| $ 50 | X | 4 | (BANKNOTES) |
| $100 | X | 5 | (BANKNOTES) |

TOTAL $1,159

DETAILS

| | |
|---|---|
| NORMAL COUNTING MODE | $1,153 |
| RELAXATION COUNTING MODE | $ 6 |

(c)

TOTAL AMOUNT OF THE DEPOSITED MONEY $1,159

| NORMAL COUNTING MODE STATEMENT | | | | RELAXATION COUNTING MODE STATEMENT | | | |
|---|---|---|---|---|---|---|---|
| $ 1 | X | 3 | (BANKNOTES) | $ 1 | X | 1 | (BANKNOTE) |
| $ 2 | X | 10 | (BANKNOTES) | $ 2 | X | 0 | (BANKNOTE) |
| $ 5 | X | 2 | (BANKNOTES) | $ 5 | X | 1 | (BANKNOTE) |
| $ 10 | X | 20 | (BANKNOTES) | $ 10 | X | 0 | (BANKNOTE) |
| $ 20 | X | 11 | (BANKNOTES) | $ 20 | X | 0 | (BANKNOTE) |
| $ 50 | X | 4 | (BANKNOTES) | $ 50 | X | 0 | (BANKNOTE) |
| $100 | X | 5 | (BANKNOTES) | $100 | X | 0 | (BANKNOTE) |

FIG. 12

BANKNOTE RECOGNITION AND COUNTING MACHINE AND BANKNOTE RECOGNITION AND COUNTING METHOD

CROSS-REFERENCE TO RELATED APPLICATION

This application is a continuation of U.S. patent application Ser. No. 13/256,938 filed on Sep. 16, 2011, which was based upon and claimed the benefit of priority from the prior PCT/JP2009/055467 filed on Mar. 19, 2009, the entire contents of which are incorporated herein by reference.

FIELD OF THE INVENTION

The present invention relates to a banknote recognition and counting machine and a banknote recognition and counting method, respectively adapted for recognizing and counting banknotes.

BACKGROUND ART

In the past, various types of machines have been used as the banknote recognition and counting machine adapted for recognizing and counting the banknotes. In general, the banknote recognition and counting machine includes a placing unit adapted for placing thereon the banknotes and feeding such placed banknotes, one by one, into a casing, a recognition and counting unit provided in the casing and adapted for recognizing and counting the banknotes respectively fed into the casing from the placing unit, and a stacking unit adapted for stacking therein the banknotes after such banknotes are recognized and counted by the recognition and counting unit and then fed to the stacking unit. Further, this banknote recognition and counting machine includes a reject unit adapted for receiving the banknotes, not respectively judged as genuine banknotes, (such as counterfeit banknotes or the like), by the recognition and counting unit, or banknotes, the denomination of which cannot be judged, or banknotes that cannot be recognized by the recognition unit. It is noted that such banknotes, respectively received in the reject unit, will be referred to as the "reject banknotes". In this case, the stacking unit and reject unit can be respectively accessed from the outside. As such, the operator can take out the banknotes stacked in the stacking unit and/or reject unit from the outside of the casing.

In the banknotes respectively recognized and counted by the recognition and counting unit, the banknotes, respectively having a stain (hereinafter, such banknotes will be referred to as the "stained banknotes"), or banknotes, respectively undergoing a transport error, such as chained, skewed or overlapped banknotes or the like (hereinafter, such banknotes will be referred to as the "transport-error banknotes") are often included. Such stained or transport-error banknotes may tend to render judgment on the denomination of money (or denomination judgment) quite difficult, thus being mistakenly judged as the counterfeit banknotes, upon performing judgment on the authenticity (or authenticity judgment), based on the recognition result on each banknote recognized by the recognition and counting unit. Therefore, such banknotes (i.e., the stained banknotes, transport-error banknotes or the like) are sometimes fed to the reject unit. Thus, such stained banknotes and/or transport-error banknotes, respectively fed to the reject unit, are manually counted by the operator, and then the count result on the so-manually-counted banknotes is added, by manual input, to the count result on the genuine banknotes.

In JP2004-265288A, one money handling machine is disclosed, in which a plurality of authenticity judgment levels are provided to be respectively used for performing the authenticity judgment for the banknotes. In this case, the recognition and counting process for the banknotes is performed, with such authenticity judgment levels being properly altered. Further, in JP2008-3665A, one banknote handling system is disclosed, in which the count result manually inputted for the reject banknotes counted in a normal counting process is compared with the count result on the reject banknotes, respectively recognized and judged, as the genuine banknotes, by the recognition unit, by using a certain authenticity judgment level set lower than the level used in the normal counting process. In this comparison, if the two count results are coincident with each other, the deposit of such banknotes is accepted.

Further, in JP2942136B2, another money handling machine is disclosed, in which the money fed to the reject unit is compulsorily deposited, and then the amount of such compulsorily deposited money is manually inputted. Additionally, in JP10-177665A, one coin handling machine is disclosed, in which two deposit modes, i.e., a normal deposit mode and a reject deposit mode, are provided. In this case, when the reject deposit mode is selected, the authenticity judgment for coins is performed by using the authenticity judgment level set properly lowered.

DISCLOSURE OF THE INVENTION

However, in the money handling machine disclosed in the above JP2004-265288A, if the threshold value for the authenticity judgment (or authenticity judgment threshold value) is altered by altering the authenticity judgment level, there is a risk that the detection for the counterfeit banknote may not be adequately performed, due to the authenticity judgment level being set lowered. Further, in this money handling machine, when the counting process for the banknotes is performed, with the denominations of money of such banknotes being mixed, it may tend to be rather difficult to clearly set the authenticity judgment level. Therefore, a substantially complicated operation is required for the operator.

Further, in the banknote handling system disclosed in the above JP2008-3665A, it is necessary to manually input the count result on the reject banknotes. Therefore, a rather complicated operation is required for the operator. Further, in this banknote handling system, when the reject banknotes are handled in such a special recognition mode that the reject banknotes are taken again in the system after the banknotes are returned to a return slot, the comparison of the count result manually inputted for the reject banknotes counted in the normal counting process, with the count result on the reject banknotes, respectively recognized and judged, as the genuine banknotes, by the recognition unit, will impose a so complicated operation on the operator.

Additionally, in the money handling machine disclosed in the above JP2942136B2, it is necessary to manually input the amount of the money compulsorily deposited, thus requiring the rather complicated operation to the operator.

Further, in the coin handling machine disclosed in the above JP10-177665A, the coins, respectively judged to be genuine upon the authenticity judgment, are once stored in a storage box. Therefore, such coins judged to be genuine cannot be taken out immediately after the authenticity judgment. Besides, since the count result on the coins, respectively judged to be genuine in the normal deposit mode, and the count result on the coins, respectively judged to be genuine in the reject deposit mode, are not displayed at a time on a display unit, it is difficult for the operator to recognize the respective count results on the coins judged to be genuine in the two deposit modes.

The present invention was made in light of the above circumstances. Therefore, it is an object of this invention to provide the banknote recognition and counting machine and banknote recognition and counting method that can respectively eliminate the need for the operation, such as the manual input or the like for inputting the count result on the banknotes, upon the authenticity judgment and/or denomination judgment for the banknotes, thereby significantly simplifying the operation required for the operator. Additionally, according to the banknote recognition and counting machine and banknote recognition and counting method of this invention, information concerning the total sum of the count result on the banknotes, respectively judged to be true upon the judgment for the banknotes by using a first judgment threshold value, and the count result on the banknotes, respectively judged to be true upon the judgment for the banknotes by using a second judgment threshold value, is outputted. As such, the operator can readily recognize the information concerning the total sum of such count results on the banknotes, respectively judged to be true, in both of one judgment mode using the first judgment threshold value and another judgment mode using the second judgment threshold value.

A banknote recognition and counting machine according to the present invention, includes: a reception unit configured to take a banknote, that is put therein, into the banknote recognition and counting machine; a stacking unit configured to stack therein the banknote; a reject unit configured to stack therein the banknote; a transport unit configured to selectively transport the banknote taken in by the reception unit, to the stacking unit or the reject unit; a recognition and counting unit provided to the transport unit and configured to recognize and count the banknote taken in by the reception unit; a control unit configured to receive a recognition result on each banknote sent from the recognition and counting unit, judge each banknote, based on the recognition result, and control the transport unit to feed each banknote judged to be true to the stacking unit, and feed each banknote not judged to be true to the reject unit, any one of a first judgment threshold value and a second judgment threshold value set smaller than the first judgment threshold value being used by the control unit upon performing judgment for the banknote, and the control unit serving to first perform judgment for the banknote by the first judgment threshold value, and then perform judgment by the second threshold value for the banknote fed to the reject unit after the judgment performed by the first judgment threshold value, and thereafter output information concerning the total sum of a count result on the banknote judged to be true upon the judgment performed by the first judgment threshold value and another count result on the banknote judged to be true upon the judgment performed by the second judgment threshold value.

According to the banknote recognition and counting machine, the control unit first performs judgment for the banknotes, by using the first judgment threshold value, and then performs the judgment, by using the second threshold value, for the banknotes, respectively fed to the reject unit after the judgment performed by using the first judgment threshold value. Then, the control unit outputs information concerning the total sum of a count result on the banknotes, respectively judged to be true upon the judgment for the banknotes performed by using the first judgment threshold value and another count result on the banknotes, respectively judged to be true upon the judgment performed by using the second judgment threshold value. Therefore, the need for inputting the count result on the banknotes, by manual input or the like means, can be eliminated, upon performing the authenticity judgment and/or denomination judgment for the banknotes. As such, this banknote recognition and counting machine can provide a significantly simplified operation. Further, since the information concerning the total sum of the transaction counter for the banknotes, respectively judged to be true upon the judgment for the banknotes by using the first judgment threshold value and the transaction counter for the banknotes, respectively judged to be true upon the judgment for the banknotes by using the second judgment threshold value, is outputted, the operator can readily recognize the information on the total sum of the transaction counters for the banknotes, respectively judged to be true, in both of the judgment modes, i.e., the judgment mode using the first judgment threshold value and the judgment mode using the second judgment threshold value.

In the banknote recognition and counting machine according to the present invention, the control unit may serve to perform authenticity judgment for the banknote, based on the recognition result on the banknote sent from the recognition and counting unit, each of the first judgment threshold value and the second judgment threshold value being an authenticity judgment value, and serve to control the transport unit to feed the banknote judged as genuine banknote upon the authenticity judgment to the stacking unit as a true banknote, as well as to feed the banknote not judged as genuine banknote, to the reject unit as a non-true banknote.

Alternatively, the control unit may serve to perform denomination judgment for the banknote, based on the recognition result on the banknote sent from the recognition and counting unit, each of the first judgment threshold value and the second judgment threshold value being a denomination judgment value, and serve to control the transport unit to feed the banknote, successfully denominated upon the denomination judgment, to the stacking unit as a true banknote, as well as to feed the banknote, that is not successfully denominated, to the reject unit, as a non-true banknote.

Alternatively, the control unit may serve to perform authenticity judgment and denomination judgment for the banknote, based on the recognition result on the banknote sent from the recognition and counting unit, and control the transport unit to feed the banknote, that is judged as a genuine banknote upon the authenticity judgment, and is successfully denominated upon the denomination judgment, to the stacking unit as a true banknote, as well as to feed the banknote that is not judged as a genuine banknote, and/or not successfully denominated, to the reject unit as a non-true banknote.

In the banknote recognition and counting machine according to the present invention, the control unit may serve to output information concerning the total amount of money and/or information concerning the total number of the banknotes by denomination, in the total sum of the count result on the banknote judged to be true upon the judgment by the first judgment threshold value and the count result on the banknote, judged to be true upon the judgment by the second judgment threshold value.

In the banknote recognition and counting machine according to the present invention, the banknote recognition and counting machine may further include a plurality of operation units, respectively configured to send an instruction to the control unit, and one operation unit may perform the judgment for the banknote using the first judgment threshold value, and another operation unit may perform the judgment for the banknote using the second judgment threshold value.

In the banknote recognition and counting machine according to the present invention, the control unit may serve to output information concerning the total sum of the count result, and information indicating which of the first or the second judgment threshold value is used, in each of the count result, upon performing the judgment for the banknote.

In this case, the control unit may serve to output information concerning the total amount of money and/or information concerning the number of the banknote by denomination for each count result.

In the banknote recognition and counting machine according to the present invention, the banknote recognition and counting machine may further include a display unit configured to display the information concerning the total sum of the count result.

In the banknote recognition and counting machine according to the present invention, the banknote recognition and counting machine may further include a printing unit configured to print the information concerning the total sum of the count result.

In the banknote recognition and counting machine according to the present invention, the banknote recognition and counting machine may further include a memory unit configured to store therein the information concerning the total sum of the count result.

In the banknote recognition and counting machine according to the present invention, the banknote recognition and counting machine may further include an annunciating unit configured to annunciate whether the judgment is to be performed, for the banknote, that has been fed to the reject unit after the judgment by the first judgment threshold value, by using again the first judgment threshold value, or by using the second judgment threshold value.

In this case, in the case the banknote fed to the reject unit is the banknote rejected for an abnormal transport, the annunciating unit may provide an annunciation of judging the banknote again by the first judgment threshold value.

Further, in the case the banknote fed to the reject unit is the banknote rejected for abnormality upon the authenticity judgment or upon the denomination judgment, the annunciating unit may provide an annunciation of judging the banknote by the second judgment threshold value.

In the banknote recognition and counting machine according to the present invention, when the banknote that has been fed to the reject unit after being judged by the first judgment threshold value is determined to be judged by the second judgment threshold value, the control unit may serve to automatically judge the banknote by the second judgment threshold value.

In the banknote recognition and counting machine according to the present invention, the control unit may selectively perform a process mode where only a counting process for the banknote fed to the reject unit is performed by the recognition and counting unit.

A banknote recognition and counting method according to the present invention includes: taking a banknote into a banknote recognition and counting machine, recognizing and counting the banknote by a recognition and counting unit, and based on a recognition result on the banknote, judging the banknote by a first judgment threshold value; feeding the banknote judged to be true to a stacking unit, and feeding the banknote, that is not judged to be true, to a reject unit, based on the judgment result on the banknote; taking again the banknote, fed to the reject unit, into the banknote recognition and counting machine, recognizing and counting the banknote by the recognition and counting unit, and judging the banknote by a second judgment threshold value set smaller than the first judgment threshold value, based on the recognition result by the recognition and counting unit; and outputting information concerning the total sum of a count result on the banknote judged to be true upon the judgment by the first judgment threshold value and another count result on the banknote judged to be true upon the judgment by the second judgment threshold value.

According to the banknote recognition and counting method, the judgment for the banknotes, by using the first judgment threshold value is first performed, and then the judgment, by using the second threshold value, is performed for the banknotes, respectively fed to the reject unit after the judgment performed by using the first judgment threshold value. Then, information, which relates to the total sum of a count result on the banknotes, respectively judged to be true upon the judgment for the banknotes performed by using the first judgment threshold value and another count result on the banknotes, respectively judged to be true upon the judgment performed by using the second judgment threshold value, is outputted. Therefore, the need for inputting the count result on the banknotes, by manual input or the like means, can be eliminated, upon performing the authenticity judgment and/or denomination judgment for the banknotes. As such, this banknote recognition and counting method can provide a significantly simplified operation. Further, since the information concerning the total sum of the transaction counter for the banknotes, respectively judged to be true upon the judgment for the banknotes by using the first judgment threshold value and the transaction counter for the banknotes, respectively judged to be true upon the judgment for the banknotes by using the second judgment threshold value, is outputted, the operator can readily recognize the information on the total sum of the transaction counters for the banknotes, respectively judged to be true, in both of the judgment modes, i.e., the judgment mode using the first judgment threshold value and the judgment mode using the second judgment threshold value.

In the banknote recognition and counting method according to the present invention, authenticity judgment may be performed upon the judgment for the banknote performed by the first judgment threshold value or the second judgment threshold value, based on the recognition result by the recognition and counting unit, each of the first judgment threshold value and the second judgment threshold value being an authenticity judgment threshold value, and when the banknote is selectively fed to the stacking unit or the reject unit, based on the judgment result, the banknote, judged as genuine banknote upon the authenticity judgment, may be fed to the staking unit as a true banknote, and the banknote, that is not judged as genuine banknote, may be fed to the reject unit as a non-true banknote.

In the banknote recognition and counting method according to the present invention, denomination judgment may be performed upon the judgment for the banknote by the first judgment threshold value or the second judgment threshold value, based on the recognition result by the recognition and counting unit, each of the first judgment threshold value and the second judgment threshold value being a denomination judgment threshold value, and when the banknote is selectively fed to the stacking unit or the reject unit, based on the judgment result, the banknote, successfully denominated upon the denomination judgment, may be fed to the staking unit as a true banknote, and the banknote, that is not successfully denominated, may be fed to the reject unit as a non-true banknote.

In the banknote recognition and counting method according to the present invention, the authenticity judgment and the denomination judgment may be respectively performed, upon the judgment for the banknote performed by the first judgment threshold value or the second judgment threshold value, based on the recognition result by the recognition and counting unit, and when the banknote is selectively fed to the stacking unit or the reject unit, based on the judgment result, the banknote, judged as a genuine banknote upon the authenticity judgment, and successfully denominated upon the denomination judgment, may be fed to the stacking unit as a true banknote, and the banknote other than the banknote judged as the true banknote may be fed to the reject unit as a non-true banknote.

BRIEF DESCRIPTION OF THE DRAWINGS

FIG. 3 is a diagram illustrating details of an operation/display unit of the banknote recognition and counting machine shown in FIG. 1 and so on.

FIG. 4 is a block diagram illustrating a control system of the banknote recognition and counting machine shown in FIG. 1 and so on.

FIG. 7 is a diagram provided for illustrating the judgment threshold values.

FIG. 8 is a flow chart illustrating a characteristic operation in the banknote recognition and counting machine shown in FIG. 1 and so on.

FIG. 9 is another flow chart further illustrating the characteristic operation in the banknote recognition and counting machine shown in FIG. 1 and so on.

FIG. 10 is a flow chart illustrating a transaction-ending process in the banknote recognition and counting machine shown in FIG. 1 and so on.

FIG. 11 is a flow chart illustrating a total clear process in the banknote recognition and counting machine shown in FIG. 1 and so on.

FIG. 12 is a diagram provided for illustrating various examples of information outputted from a control unit, when the characteristic operation is performed in the banknote recognition and counting machine shown in FIG. 1 and so on.

DETAILED DESCRIPTION OF THE INVENTION

Figure 1A:
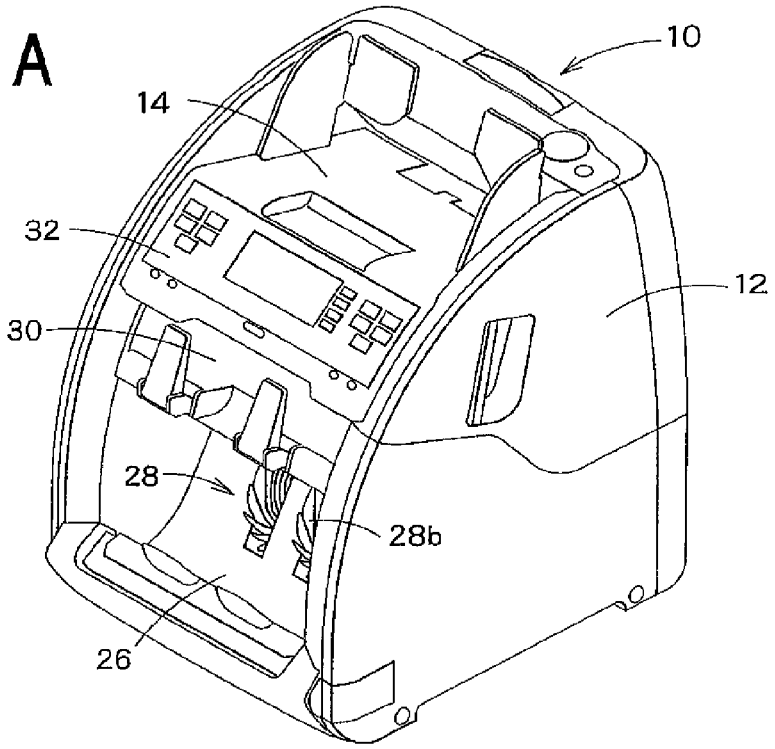
FIG. 1A is a perspective view provided for showing external appearance of the banknote recognition and counting machine related to one embodiment of the present invention, when a shutter is evacuated from an opening provided in a front face of the stacking unit.
Figure 1B:
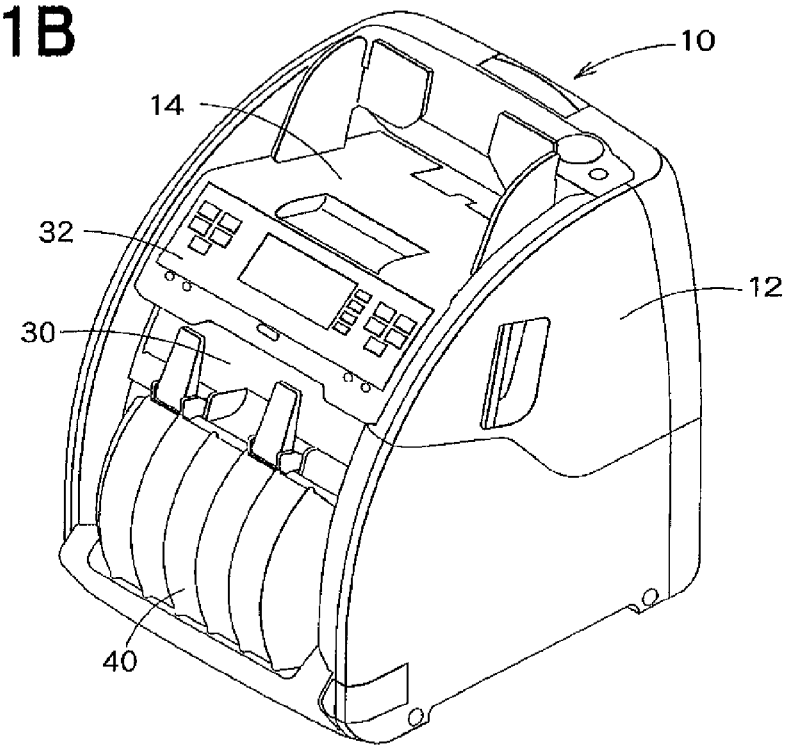
FIG. 1B is another perspective view provided for showing the external appearance of the banknote recognition and counting machine related to the embodiment of the present invention, when the shutter closes the opening provided in the front face of the stacking unit.
Figure 2:
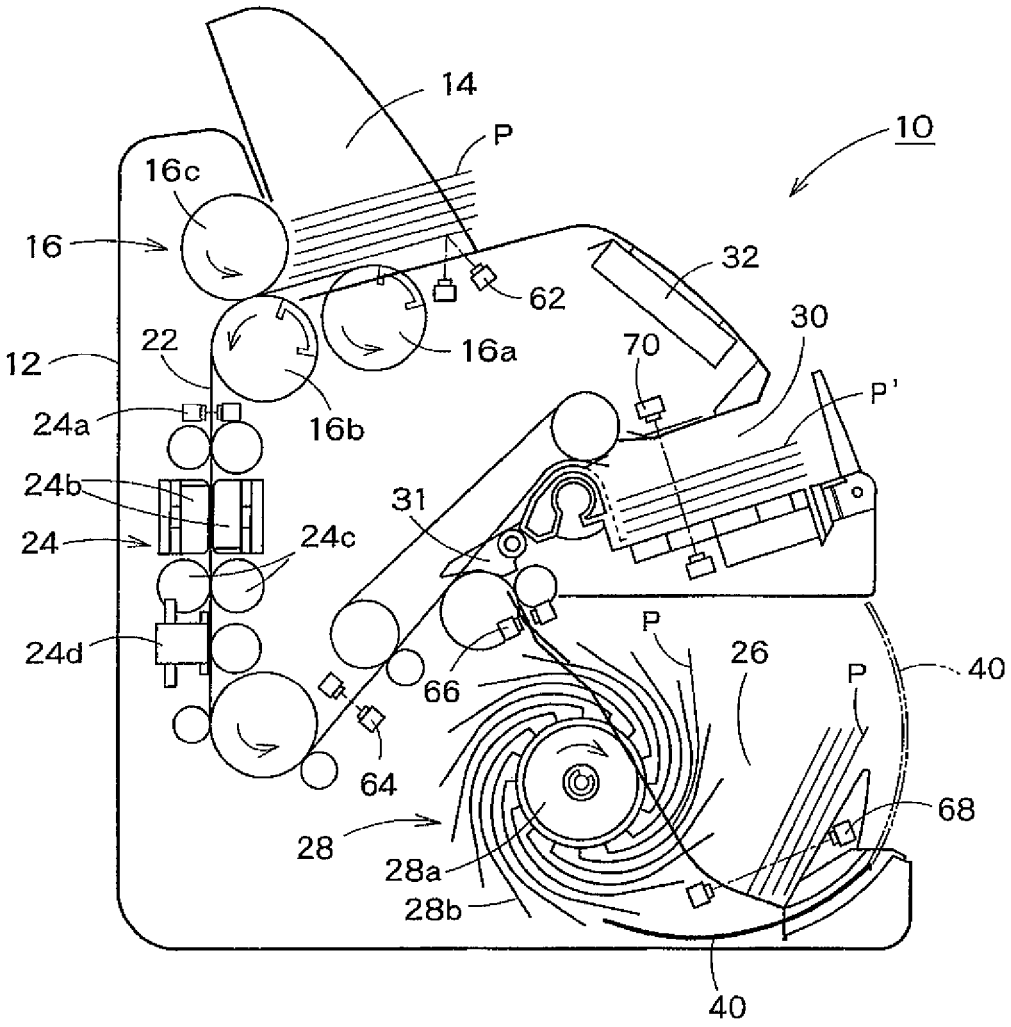
FIG. 2 is a diagram schematically illustrating the internal construction of the banknote recognition and counting machine shown in FIGS. 1A and 1B.
Figure 3:
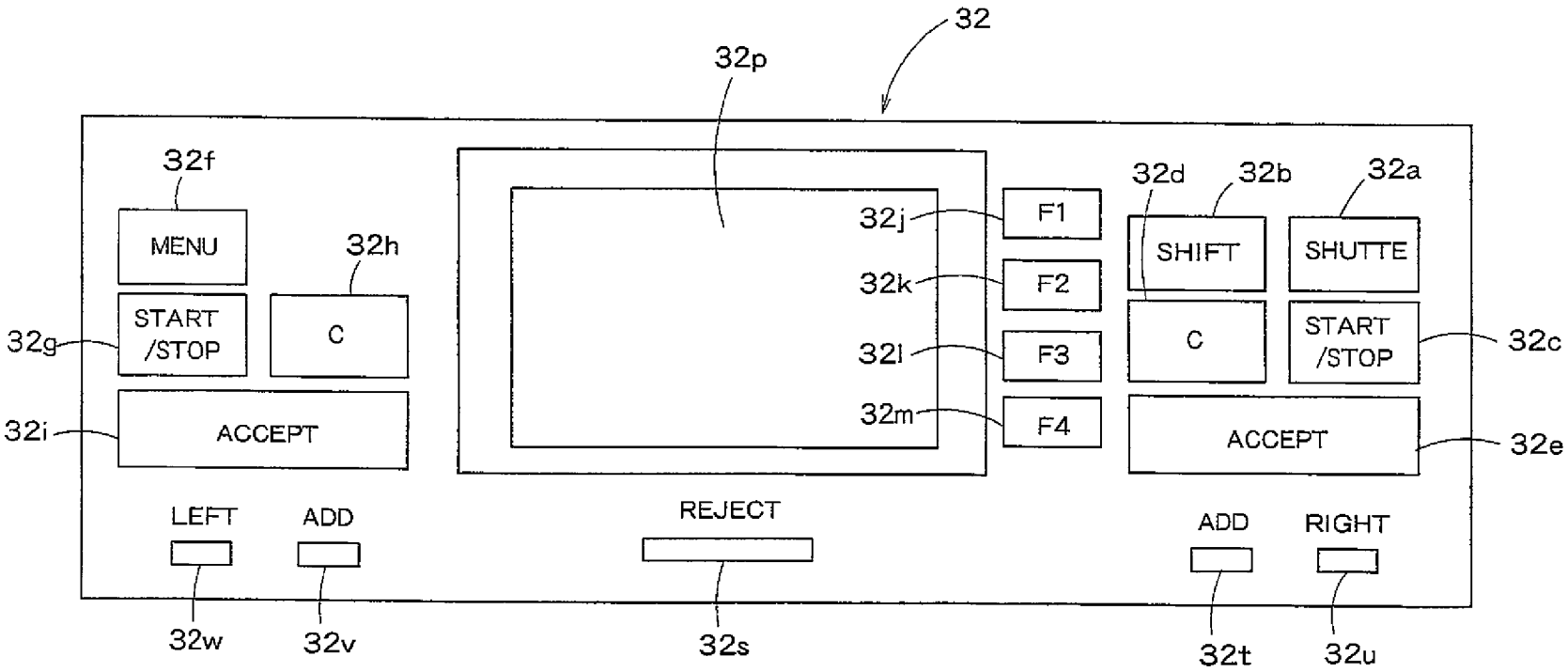
Figure 4:
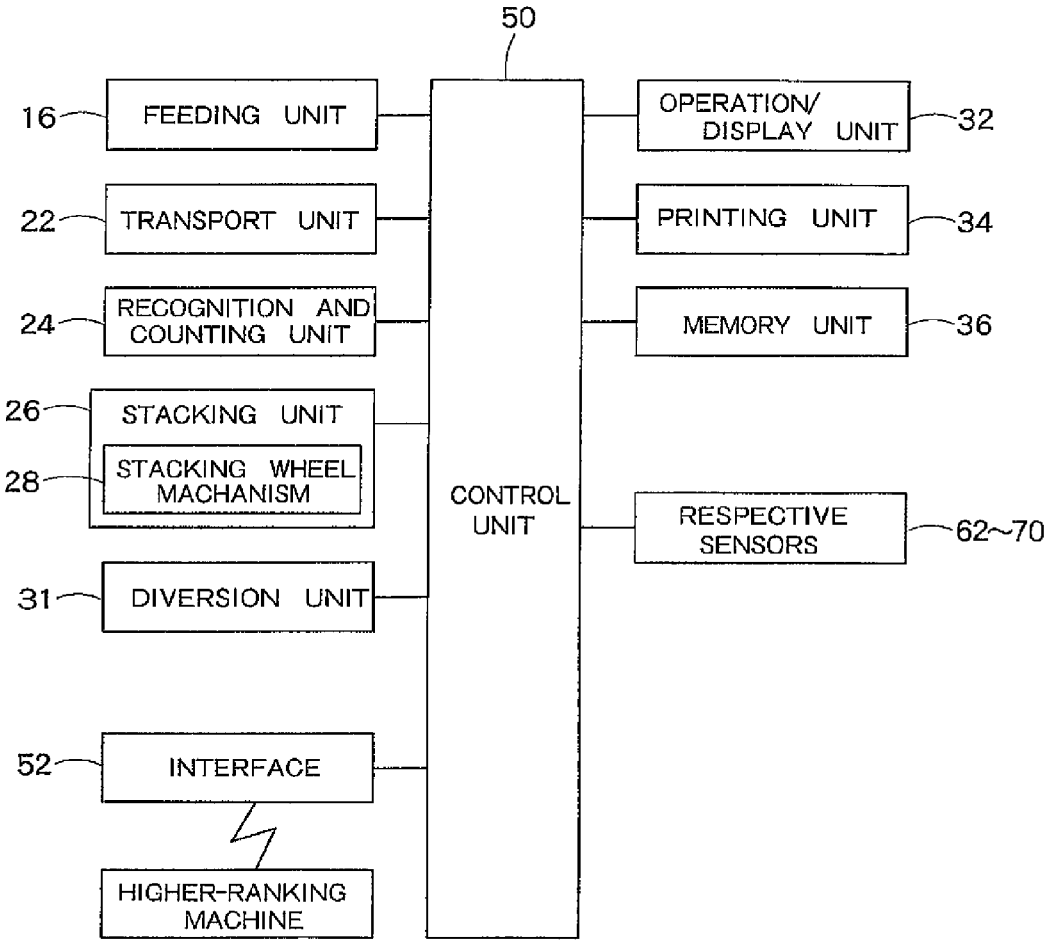
Figure 5:
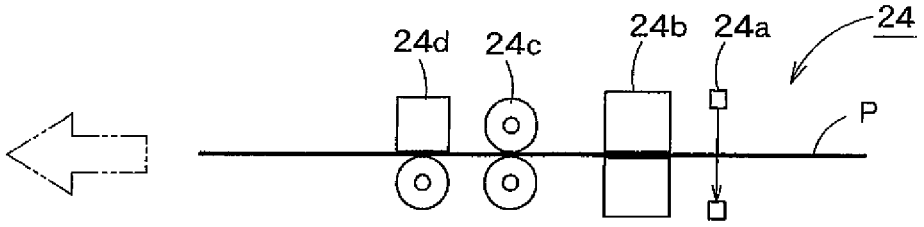
FIG. 5 is a side view schematically illustrating construction of the recognition and counting unit of the banknote recognition and counting machine shown in FIG. 2.
Figure 6:
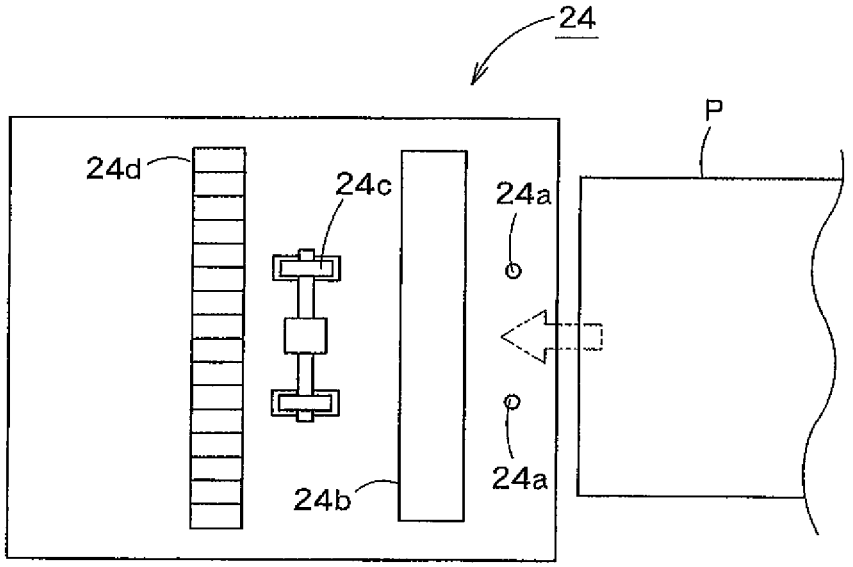
FIG. 6 is a schematic view of the recognition and counting unit shown in FIG. 5, when the recognition and counting unit is seen from above.
Figure 8:
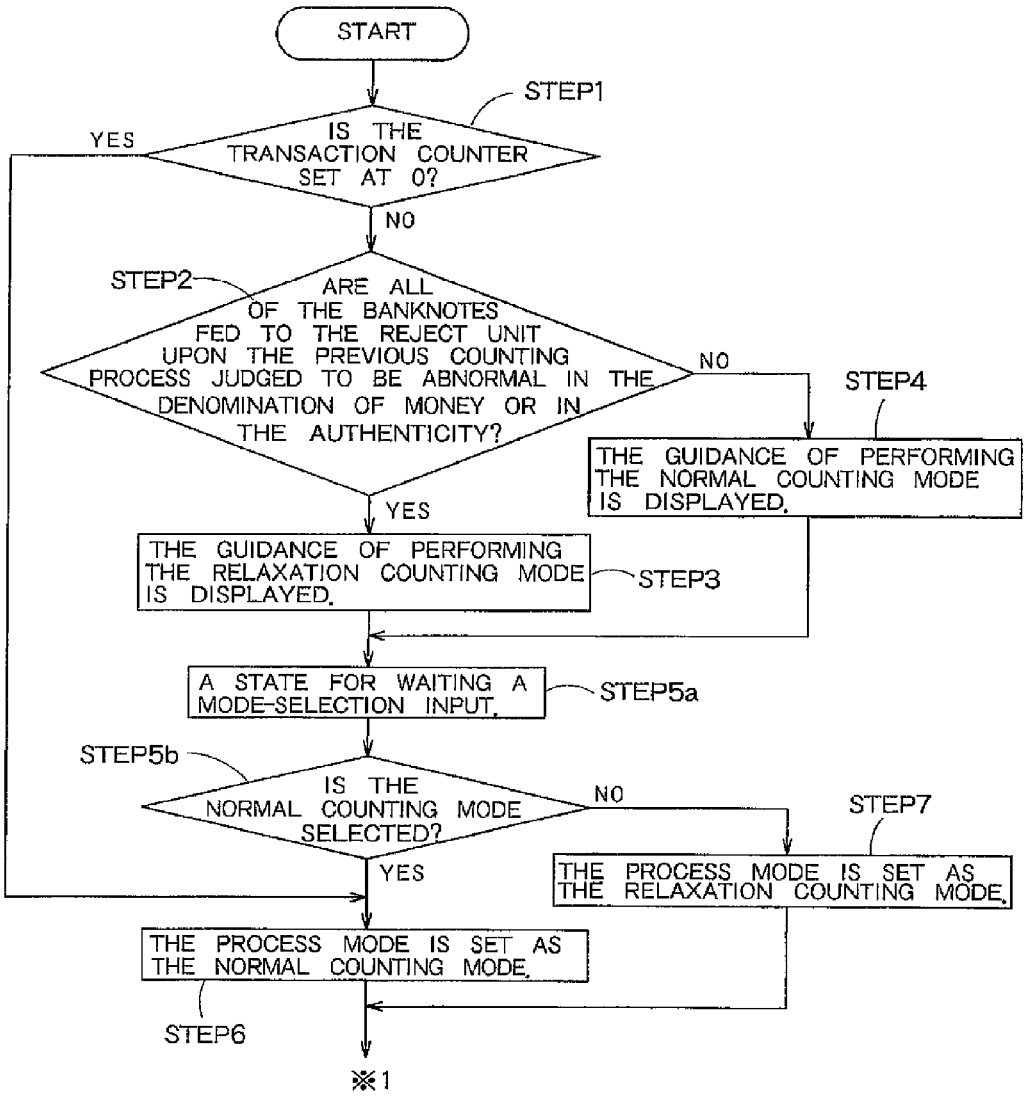
Figure 9:
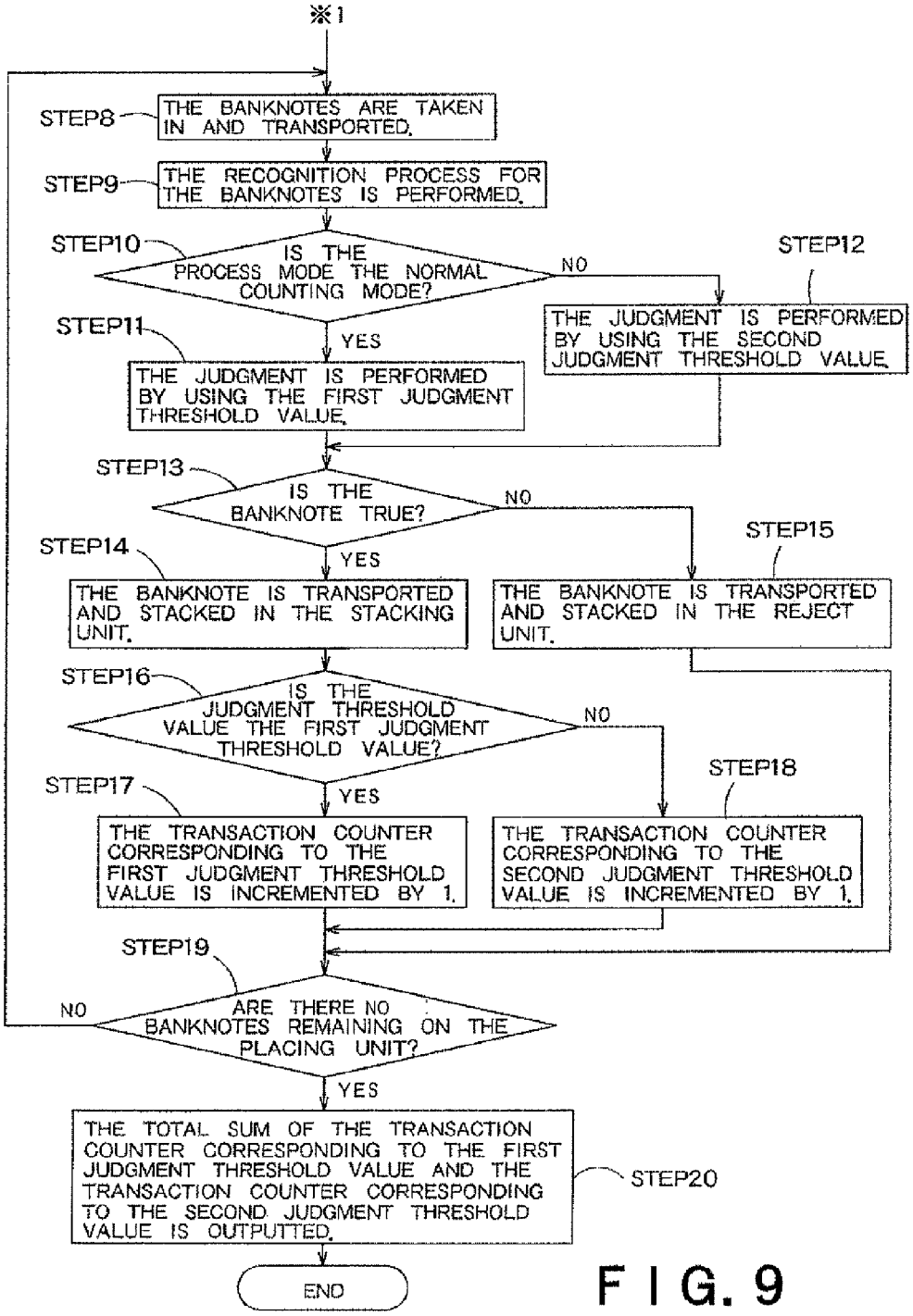
Figure 10:
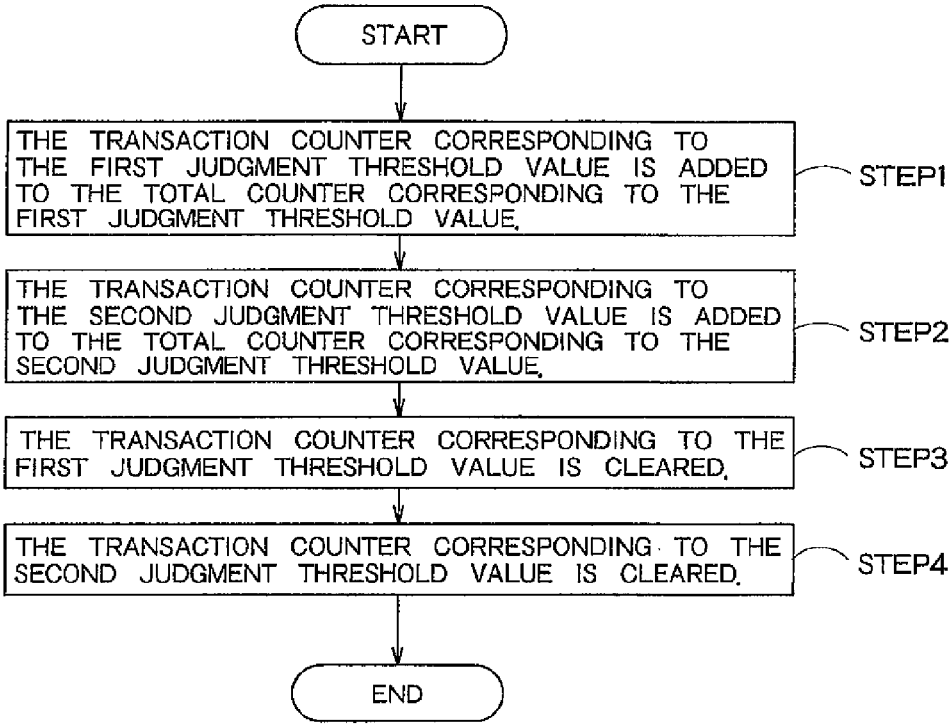
Figure 11:
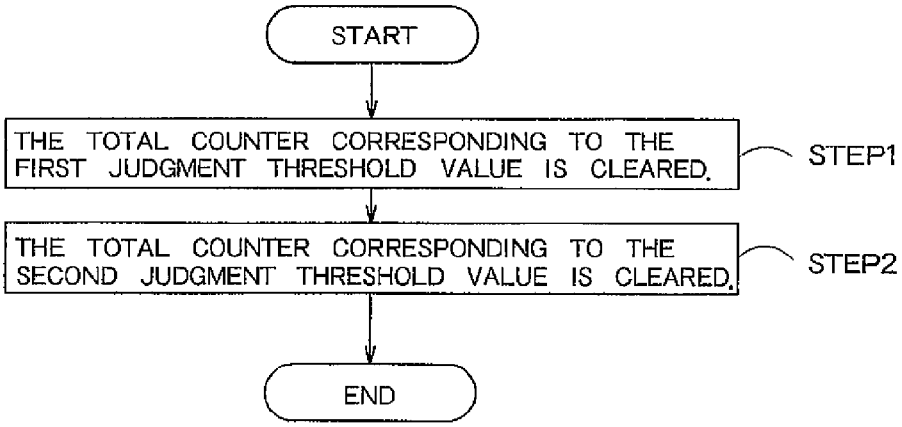

Hereinafter, one embodiment of the present invention will be described, with reference to the drawings. As used herein, FIGS. 1 through 12 are provided for respectively illustrating the banknote recognition and counting machine related to the embodiment. Of these drawings, FIGS. 1A and 1B respectively illustrate one perspective view of the banknote recognition and counting machine related to this embodiment. FIG. 2 schematically illustrates the internal construction of the banknote recognition and counting machine shown in FIGS. 1A and 1B, and FIG. 3 illustrates the details of the operation/display unit of the banknote recognition and counting machine shown in FIG. 1 and so on. FIG. 4 illustrates one exemplary control system of the banknote recognition and counting machine shown in FIG. 1 and so on. The side view of FIG. 5 schematically illustrates the construction of the recognition and counting unit provided in the banknote recognition and counting machine shown in FIG. 2. FIG. 6 schematically illustrates the recognition and counting unit shown in FIG. 5, when this recognition and counting unit is seen from above. FIG. 7 is provided for illustrating the judgment threshold values. The flow charts of FIGS. 8 and 9 are respectively provided for illustrating one characteristic operation in the banknote recognition and counting machine shown in FIG. 1 and so on. The flow chart of FIG. 10 illustrates the transaction-ending process performed in the banknote recognition and counting machine shown in FIG. 1 and so on. The flow chart of FIG. 11 is provided for illustrating the total clear process in the banknote recognition and counting machine shown in FIG. 1 and so on. Further, FIG. 12 illustrates various examples of information outputted from the control unit, when the characteristic operation is performed in the banknote recognition and counting machine shown in FIG. 1 and so on.

As illustrated in FIGS. 1A, 1B and 2, a banknote recognition and counting machine 10 includes a casing 12 and a placing unit 14 adapted for placing thereon a plurality of banknotes P to be respectively counted, in a stacked condition. Further, this banknote recognition and counting machine 10 includes a feeding unit 16 adapted for feeding each banknote P located at the lowermost layer of the banknotes P placed on the placing unit 14 in the stacked condition, one by one, into the casing 12, and a transport unit 22 adapted for transporting the banknotes P, respectively fed into the casing 12 by the feeding unit 16, one by one. In addition, a recognition and counting unit 24 adapted for recognizing and counting the banknotes P respectively fed into the casing 12 from the placing unit 14 is provided to the transport unit 22.

The feeding unit 16 includes a kicker roller 16*a* provided to be in contact with the surface of the banknote P located at the lowermost layer of the banknotes P placed on the placing unit 14 in the stacked condition, and a feed roller 16*b* located on the downstream side, in the feeding direction of the banknotes P, relative to the kicker roller 16*a*, and adapted for feeding the banknotes P, respectively kicked out by the kicker roller 16*a*, into the casing 12. Further, a gate roller (or reverse rotation roller) 16*c* is provided to be opposed to the feed roller 16*b*, with a gate part provided between the feed roller 16*b* and the gate roller 16*c*. Thus, each banknote P kicked out by the kicker roller 16*a* is passed through the gate part and then fed out, one by one, toward the transport unit 22 in the casing 12.

Now, referring to FIGS. 2, 5 and 6, the construction of the recognition and counting unit 24 will be detailed. The side view of FIG. 5 schematically illustrates the construction of the recognition and counting unit 24, and FIG. 6 schematically illustrates the recognition and counting unit 24 shown in FIG. 5, when this recognition and counting unit 24 is seen from above. As illustrated in FIGS. 2, 5 and 6, the recognition and counting unit 24 includes a timing sensor 24*a*, a line sensor 24*b*, a thickness sensor 24*c* and a magnetic array 24*d*, respectively arranged in this order from the upstream side in the transport direction of the banknotes P. In FIGS. 5 and 6, reference character P denotes one banknote P transported in the recognition and counting unit 24, and an arrow shown by a two-dot chain line indicates the transport direction of each banknote P.

In this case, as shown in FIGS. 5 and 6, a pair of left and right timing sensors 24*a*, 24*a* are provided to be respectively located on the left and right sides relative to the transport path for each banknote P, on the most upstream side in the recognition and counting unit 24. Each timing sensor 24*a*, 24*a* can serve to detect arrival of each banknote P at the recognition and counting unit 24.

The line sensor 24*b* is provided on the downstream side relative to the timing sensors 24*a*, 24*a*, in the transport direction of the banknotes P. This line sensor 24*b* includes a first light emitting part and a first light receiving part, respectively arranged vertically across the transport path for the banknotes P. As such, the light (e.g., infrared light) radiated from the first light emitting part can be received by the first light receiving part. With this configuration, when one banknote P is fed into the line sensor 24*b*, the light radiated from the first light emitting part reaches the first light receiving part, after this light is transmitted through the banknote P located in the line sensor 24*b*. In this way, one detection value is calculated on the basis of the data on the light received by the first light receiving part. In this case, the detection value calculated by using the first light emitting part and first light receiving part is referred to as "IR1". Further, the line sensor 24*b* includes a second light emitting part and a second light receiving part, respectively provided on one side relative to the transport path for the banknotes P. With this configuration, the light (e.g., red light) radiated from the second light emitting part is received by the second light receiving part, after reflected by the banknote P located in the line sensor 24*b*. Then, another detection value is calculated on the basis of the data on the light received by the second light receiving part. In this case, the detection value calculated by using the second light emitting part and second light receiving part is referred to as "IR2".

The thickness sensor 24*c* is provided on the downstream side relative to the line sensor 24*b*, in the transport direction of the banknotes P. This thickness sensor 24*c* can serve to detect the thickness of each banknote P. With the provision of this thickness sensor 24*c*, each banknote P having some folded part, two or more banknotes P overlapped with one another, each banknote P having a tape or the like attached thereto, or the like can be detected.

On the downstream side relative to the thickness sensor 24*c* in the transport direction of the banknotes P, the magnetic array 24*d* is provided. This magnetic array 24*d* includes magnetic heads, respectively arranged to constitute 16 channels. With the provision of this magnetic array 24*d*, some magnetism generated from a magnetic component contained in an ink or the like used for each banknote P can be detected. In this case, the detection value calculated by using the magnetic array 24*d* is referred to as "MG1".

As shown in FIG. 2, the transport unit 22 is bifurcated into two transport paths, at a point located on the downstream side relative to the recognition and counting unit 24, and one of the two transport paths is connected with a stacking unit 26, while the other transport path is connected with a reject unit 30. With this configuration, the banknotes P that have been respectively recognized and counted by the recognition and counting unit 24 can be selectively fed to the stacking unit 26 or reject unit 30. An opening is provided in the front face of the stacking unit 26 (i.e., the face of the stacking unit 26 depicted on the right side in FIG. 2), such that the operator can take out the banknotes P respectively stacked in the stacking unit 26, via this opening. Further, another opening is provided in the front face of the reject unit 30, such that the operator can take out the banknotes P' respectively stacked in the reject unit 30, via this opening.

Further, as shown in FIG. 2, a diversion unit 31, including a diverter and a drive unit (not shown) for driving the diverter, is provided at the point where the transport unit 22 is bifurcated into the two transport paths. Due to this diversion unit 31, each banknote P that has been fed from the upstream side of the diversion unit 31 can be selectively fed to either one of the two bifurcated transport paths.

A stacking wheel mechanism 28 is provided on the back face side of the stacking unit 26 in the casing 12 (i.e., in a position located on the left side in the stacking unit 26 in FIG. 2). This stacking wheel mechanism 28 is composed of a stacking wheel 28*a* and a drive unit (not shown) for driving the stacking wheel 28*a*. This stacking wheel 28*a* is provided to be rotated in a clockwise direction (i.e., the direction indicated by an arrow depicted in FIG. 2) about a shaft extending in a substantially horizontal direction orthogonal to the sheet of FIG. 2. In this stacking wheel 28*a*, a plurality of vanes 28*b* are provided to extend outward, from an outer circumferential face of the wheel 28*a*, in a direction reverse to the rotation direction of the wheel 28*a* (i.e., the anticlockwise direction in FIG. 2). More specifically, such vanes 28*b* are arranged on the outer circumferential face of the stacking wheel 28*a*, at an equal interval, as shown in FIG. 2.

The stacking wheel 28*a* of the stacking wheel mechanism 28 is provided to be constantly rotated, by the driving unit, in the clockwise direction, as depicted in FIG. 2, during the operation of the banknote recognition and counting machine 10, thereby to receive the banknotes P, respectively fed from the transport unit 22, one by one. More specifically, the stacking wheel 28*a* can serve to receive each banknote P fed from the transport unit 22 between the two vanes 28*b* thereof, and then feed the banknote P received between the two vanes 28*a* into the stacking unit 26. In this way, the banknotes P can be fed to the stacking unit 26, one by one, from the stacking wheel 28*a*, as such the plurality of banknotes P can be stacked in the stacking unit 26.

In the banknote recognition and counting machine 10, as shown in FIGS. 1B, 2 and so on, a shutter 40 is provided to close the opening provided in the front face of the stacking unit 26, such that the opening in the front face of the stacking unit 26 can be selectively closed by the shutter 40. By means of a shutter drive unit (not shown) for driving the shutter 40, the shutter 40 can be moved, between an opening position, as depicted in FIG. 1A, in which the shutter 40 is evacuated from the opening in the front face of the stacking unit 26 in order to open the opening, and a closing position, as depicted in FIG. 1B, for closing the opening in the front face of the stacking unit 26. Namely, when the shutter 40 is located in the opening position as depicted in FIG. 1A, the shutter 40 is evacuated from the opening in the front face of the stacking unit 26 and thus the opening is opened, thereby allowing the operator to access the banknotes P respectively stacked in the stacking unit 26. Meanwhile, when the shutter 40 is located in the closing position as depicted in FIG. 1B, the opening in the front face of the stacking unit 26 is closed by the shutter 40, thus preventing the operator from accessing the banknotes P respectively stacked in the stacking unit 26. In FIG. 2, the shutter 40 located in the opening position is depicted by a solid line, while the shutter 40 located in the closing position is depicted by a two-dot chain line.

With the provision of the shutter 40 as described above, when the opening in the front face of the stacking unit 26 is closed by the shutter 40, as shown in FIG. 1B, the risk that the dust may be blown out toward the operator with the rotation of the stacking wheel 28*a* of the stacking wheel mechanism 28 can be effectively suppressed. Further, by closing the opening in the front face of the stacking unit 26 by using the shutter 40, unwanted leakage of a sound generated from the interior of the banknote recognition and counting machine 10 toward the outside during the operation of this machine 10 can be successfully prevented.

Further, as shown in FIG. 2, various sensors are provided to the banknote recognition and counting machine 10. Specifically, to the placing unit 14, a placing-unit-residue banknote detection sensor 62 composed of a reflection-type optical sensor is provided for detecting whether or not there are some banknotes P remaining on the placing unit 14. Further, a diversion timing sensor 64 composed of an optical sensor is provided on the upstream side relative to the diversion unit 31 in the transport unit 22. In this case, the diverter of the diversion unit 31 can be optionally moved to either one of a first position for feeding each banknote P to the stacking unit 26 and a second position for feeding each banknote P to the reject unit 30 (in FIG. 2, the diverter of the diversion unit 31 is located in the position for feeding each banknote P to the stacking unit 26), at each timing on which the banknote P is detected by the diversion timing sensor 64. Thus, each banknote P transported by the transport unit 22 and then detected by the diversion timing sensor 64 is selectively fed to either one of the two transport paths by the diversion unit 31.

Additionally, a banknote tracking detection sensor 66 is provided to the transport path located on the side of the stacking unit 26, among the two transport paths bifurcated at the point where the diversion unit 31 is located. This banknote tracking detection sensor 66 is composed of a proper optical sensor adapted for detecting each banknote P fed to the transport path arranged on the side of the stacking unit 26. Namely, with the provision of this banknote tracking detection sensor 66, each banknote P that has been fed, by the diversion unit 31, to the transport path arranged on the side of the stacking unit 26 can be detected. Further, in the stacking unit 26, a stacking-unit banknote detection sensor 68 is provided. This stacking-unit banknote detection sensor 68 is composed of another optical sensor adapted for detecting whether or not there are some banknotes P stacked in the stacking unit 26. In addition, a reject-unit banknote detection sensor 70 is provided in the reject unit 30. This reject-unit banknote detection sensor 70 is composed of another proper optical sensor adapted for detecting whether or not there are some reject banknotes P' stacked in the reject unit 30.

Further, as shown in FIG. 4, the banknote recognition and counting machine 10 includes a control unit 50. This control unit can serve to control each component of the banknote recognition and counting machine 10. More specifically, this control unit 50 is connected with each of the feeding unit 16, transport unit 22, recognition and counting unit 24, stacking unit 26 including the stacking-wheel drive mechanism 28, diversion unit 31 and the like. In this case, the recognition and counting result on each banknote P recognized by the recognition and counting unit 24 is sent to the control unit 50, while the control unit 50 sends an instruction signal to each of the feeding unit 16, transport unit 22, stacking unit 26, diversion unit 31 and the like, in order to control such components. Further, the control unit 50 is connected with each of the placing-unit-residue banknote detection sensor 62, diversion timing sensor 64, banknote tracking detection sensor 66, stacking-unit banknote detection sensor 68 and reject-unit banknote detection sensor 70, in order to receive each detection result of such sensors 62 to 70.

Further, the control unit 50 is connected with an operation/display unit 32. As shown in FIG. 1 and so on, the operation/display unit 32 is provided to a front face of the casing 12. In this case, the condition (or process condition) under which the banknotes P are handled or processed in the banknote recognition and counting machine 10, more specifically the information on the number for each denomination of money, total amount of money or the like of the banknotes P counted by the recognition and counting unit 24, can be displayed on the operation/display unit 32. Additionally, the operator can input various commands to the control unit 50 via the operation/display unit 32.

Now, referring to FIG. 3, more specific construction of the operation/display unit 32 will be described. As shown in FIG. 3, the operation/display unit 32 has a laterally elongated and substantially rectangular shape, and includes a display unit 32*p* composed of, for example, an LCD or the like, and provided at a laterally central part of the operation/display unit 32. In this case, the display unit 32*p* can serve to display the process condition for the banknotes P in the banknote recognition and counting machine 10, more specifically the information on the operational mode of the banknote recognition and counting machine 10, information on the number for each denomination of money, total amount of money or the like of the banknotes P counted by the recognition and counting unit 24, error information and the like.

On the right side of the display unit 32*p* in the operation/display unit 32, a SHUTTE (shutter) key 32*a*, a SHIFT key 32*b*, a START/STOP key 32*c*, a C (clear) key 32*d* and an ACCEPT key 32*e* are provided, respectively. Further, on the left side of the display unit 32*p* in the operation/display unit 32, a MENU key 32*f*, another START/STOP key 32*g*, another C (clear) key 32*h* and another ACCEPT key 32*i* are provided, respectively. Additionally, in a right adjacent portion relative to the display unit 32*p*, an F1 (a first function) key 32*j*, an F2 (a second function) key 32*k*, an F3 (a third function) key 321 and an F4 (a fourth function) key 32*m* are vertically arranged, in this order from the top. Furthermore, in a lower portion of the operation/display unit 32, a reject lamp 32*s*, an ADD (addition) lamp 32*t*, a RIGHT (right-side) lamp 32*u*, another ADD lamp 32*v* and a LEFT (left-side) lamp 32*w* are provided, respectively. It is noted that the respective function keys (i.e., the F1 key 32*j* to F4 key 32*m*) are provided to be selectively pushed down, upon performing various commands respectively displayed in a left adjacent portion in the display unit 32*p*.

For instance, when the operator pushes down the SHUTTE key 32*a* of the operation/display unit 32, the shutter 40 is moved from the opening position as depicted in FIG. 1A to the closing position as depicted in FIG. 1B or moved from the closing position as depicted in FIG. 1B to the opening position as depicted in FIG. 1A, by the shutter drive unit (not shown). In this manner, each time the SHUTTE key 32 is pushed down, the opening and closing operation of the shutter 40 is performed.

Further, as shown in FIG. 4, a printing unit 34 composed of, for example, a printer, is connected with the control unit 50 of the banknote recognition and counting machine 10. This printing unit 34 may be provided to the casing 12 of the banknote recognition and counting machine 10, or otherwise may be provided separately from the casing 12. In addition, a memory unit 36 is connected with the control unit 50 of the banknote recognition and counting machine 10. This memory unit 36 is provided for storing therein the information on the number for each denomination of money, total amount of money or the like of the banknotes P counted by the recognition and counting unit 24. Furthermore, an interface 52 is connected with the control unit 50, such that the control unit 50 can transmit and receive a signal relative to a higher-ranking machine, such as a host computer or the like, via the interface 52.

Next, the operation of the banknote recognition and counting machine 10 constructed as described above will be discussed. It is noted that the operation of the banknote recognition and counting machine 10, as will be described below, is performed by controlling each component of this machine 10 under the control of the control unit 50.

First, a basic operation of the banknote recognition and counting machine 10 will be described.

First of all, the operator places the banknotes P to be respectively counted, on the placing unit 14, in the stacked condition. Thereafter, when the operator pushes down the START/STOP key 32*c* or 32*g* in the operation/display unit 32 to give a command for starting the counting process for the banknotes P to the control unit 50, the banknotes P respectively placed in the stacked condition on the placing unit 14 are fed to the transport unit 22 in the casing 12, one by one, successively, by the feeding unit 16, from the banknote P located at the lowermost layer, and then transported by the transport unit 22. During this operation, the recognition and counting process for the banknotes P is performed by the recognition and counting unit 24. Then, the recognition result on each banknote P recognized by the recognition and counting unit 24 is sent to the control unit 50, and thus the control unit 50 judges each banknote based on the recognition result of the banknote. As a result, each banknote P judged to be true is further transported by the transport unit 22 and fed to the stacking unit 26 by the diversion unit 31. Meanwhile, each banknote P' not judged to be true is further transported by the transport unit 22 and fed to the reject unit 30 by the diversion unit 31. Once the banknote P' is fed to the reject unit 30, the reject lamp 32*s* is turned on. "Each banknote P judged to be true" and "each banknote P' not judged to be true" will be detailed later.

Now, the judgment for each banknote by the control unit 50 will be described in more detail. In a first aspect of the judgment for each banknote P performed by the control unit 50, the control unit 50 performs the authenticity judgment for the banknote P, based on the recognition result on this banknote P sent from the recognition and counting unit 24. Upon performing such authenticity judgment for each banknote P, a proper authenticity judgment threshold value is used as the judgment threshold value. In this case, as the authenticity judgment threshold value, a plurality of judgment threshold values are set, respectively corresponding to the sensors, respectively constituting the recognition and counting unit 24. More specifically, upon performing the recognition process for each banknote P by using the recognition and counting unit 24, the detection values IR1, IR2, MG1 are respectively calculated by the sensors (i.e., the line sensor 24*b*, magnetic array 24*d* and the like), respectively constituting the recognition and counting unit 24, and then respectively compared with the authenticity judgment threshold values, respectively corresponding to such sensors. Thereafter, if all of the detection values are respectively greater than the authenticity judgment threshold values respectively corresponding to the respective sensors, the banknote P upon this judgment is judged as the genuine banknote. Namely, this banknote P is judged to be true. Meanwhile, if at least one of the detection values calculated by the sensors respectively constituting the recognition and counting unit 24 is smaller than the authenticity judgment threshold value provided for the corresponding sensor, the banknote P upon this judgment is not judged as the genuine banknote, and is thus judged as the counterfeit banknote. Thus, this banknote P is not judged to be true. Further, in the case some transport error, such as the chained, skewed or overlapped banknote transportation or the like, occurs during the transportation for the banknotes P performed by the transport unit 22, such a transport error of the banknotes P is detected by the recognition and counting unit 24. In this case, such transport-error banknotes P are not judged to be true, respectively.

In a second aspect of the judgment for each banknote P performed by the control unit 50, the control unit 50 performs the denomination judgment for the banknote P, based on the recognition result on this banknote P sent from the recognition and counting unit 24. Upon performing such denomination judgment for each banknote P, a proper denomination judgment threshold value is used, for each denomination of money, as the judgment threshold value. In this case, as the denomination judgment threshold value for each denomination of money, a plurality of judgment threshold values are provided, respectively corresponding to the sensors, respectively constituting the recognition and counting unit 24. More specifically, upon performing the recognition process for each banknote P by using the recognition and counting unit 24, the detection values IR1, IR2, MG1 are respectively calculated by the sensors, respectively constituting the recognition and counting unit 24, and then respectively compared with the denomination judgment threshold values, for each denomination of money, respectively corresponding to such sensors. Thereafter, if all of the detection values are respectively greater than the denomination judgment threshold values, for a certain denomination of money, respectively corresponding to the respective sensors, the banknote P upon this judgment is judged as the banknote of that certain denomination of money, and is further judged to be true. Meanwhile, if a certain banknote P is judged as one not corresponding to the banknote P of any related denomination of money, upon the comparison of the detection values with the respectively corresponding denomination judgment threshold values, for each denomination of money, this banknote P is not judged to be true. Further, in the case some transport error, such as the chained, skewed or overlapped banknote transportation or the like, occurs during the transportation for the banknotes P performed by the transport unit 22, this transport error of the banknotes P is detected by the recognition and counting unit 24. In this case, such transport-error banknotes P are not judged to be true, respectively.

In a third aspect of the judgment for each banknote P performed by the control unit 50, the control unit 50 performs both of the authenticity judgment and denomination judgment, for the banknote P, based on the recognition result on this banknote P sent from the recognition and counting unit 24. Upon performing such authenticity judgment and denomination judgment, for each banknote P, both of the authenticity judgment threshold values and denomination judgment threshold values for each denomination of money of the banknote P, are respectively used as the judgment threshold value. As described above, the plurality of authenticity judgment threshold values and the plurality of denomination judgment threshold values for each denomination of money, are provided, respectively corresponding to the sensors, respectively constituting the recognition and counting unit 24. More specifically, upon performing the recognition process for each banknote P by using the recognition and counting unit 24, the detection values IR1, IR2, MG1 are respectively calculated by the sensors, respectively constituting the recognition and counting unit 24, and then compared with the authenticity judgment threshold values, respectively corresponding to the respective sensors, as well as compared with the denomination judgment values for each denomination of money, respectively corresponding to the respective sensors. Thereafter, if all of the detection values are respectively greater than the authenticity judgment threshold values respectively corresponding to the respective sensors, as well as greater than the denomination judgment threshold values for a certain denomination of money, respectively corresponding to the respective sensors, the banknote P upon this judgment is judged as the genuine banknote as well as judged as the banknote of that certain denomination of money. Thus, this banknote P is judged to be true. Meanwhile, if a certain banknote P is not judged as the genuine banknote, or if a certain banknote P is judged as one not corresponding to the banknote P of any related denomination of money, upon the comparison between the detection values and the respectively corresponding authenticity judgment threshold values or denomination judgment threshold values for each denomination of money, this banknote P is not judged to be true. Further, in the case some transport error, such as the chained, skewed or overlapped banknote transportation or the like, occurs during the transportation for the banknotes P performed by the transport unit 22, this transport error of the banknotes P is detected by the recognition and counting unit 24. In this case, such transport-error banknotes P are not judged to be true, respectively.

In short, any one of the above first to third aspects is implemented herein, as one method for judging each banknote by using the control unit 50.

Specifically, the banknotes P, respectively judged as the true banknote P by the control unit 50 on the basis of the recognition result obtained by the recognition and counting unit 24, are further transported by the transport unit 22 and respectively fed to the stacking unit 26 by the diversion unit 31. During this operation, each banknote P is fed, one by one, from the transport unit 22, to the stacking wheel 28*a* of the stacking wheel mechanism 28. This stacking wheel 28*a* can serve to receive each banknote P fed from the transport unit 22, between the two vanes 28*b* thereof, and then feed this banknote P received between the two vanes 28*b* into the stacking unit 26. In this way, the banknotes P can be arranged in the stacking unit 26, by the stacking wheel mechanism 28. Since the opening is provided in the front face of the stacking unit 26, the operator can take out such banknotes P respectively stacked in the stacking unit 26, via the opening.

Meanwhile, the banknotes P', not respectively judged to be true by the control unit 50 on the basis of the recognition result obtained by the recognition and counting unit 24, are further transported by the transport unit 22 and fed to the reject unit 30 by the diversion unit 31. Since the opening is provided in the front face of the reject unit 30, the operator can take out such banknotes P' respectively stacked in the reject unit 30, via the opening.

Now, one operation mode of the banknote recognition and counting machine 10, upon performing the operation of this machine 10 as described above, will be described. In this operation mode of the banknote recognition and counting machine 10, various functions, such as a counting mode function, a counting process function, a setting function and a double-operational function, are provided, respectively. First, such functions will be described, respectively.

As the counting mode function, four modes, i.e., a first mixed-denomination deposit mode (MIX mode), a second mixed-denomination deposit mode (MIX 2 mode), a different denomination mode (DD mode), and a counting mode (CNT mode), are provided, respectively.

In the first mixed-denomination deposit mode, the operator places the banknotes P on the placing unit 14, with the denominations of money of the banknotes P being mixed. Then, the counting process for such banknotes P is performed in the banknote recognition and counting machine 10, with the denominations of money being mixed, in order to calculate the number for each denomination of money, total amount of money or the like of the banknotes P. In the second mixed-denomination deposit mode, as is similar to the case of first mixed-denomination deposit mode, the operator places the banknotes P on the placing unit 14, with the denominations of money of the banknotes P being mixed. Then, the counting process for such banknotes P is performed in the banknote recognition and counting machine 10, with the denominations of money being mixed, in order to calculate the number for each denomination of money, total amount of money or the like of the banknotes P. However, in this second mixed-denomination deposit mode, when the denomination of money of a certain banknote P judged by the control unit 50 on the basis of the recognition result on this banknote P recognized by the recognition and counting unit 24 is different from the denomination of money of the banknote P that has been handled or judged just before the certain banknote P, the process for such banknotes P in the banknote recognition and counting machine 10 is once stopped. This second mixed-denomination deposit mode is convenient for the operator, in the case of sorting the banknotes, for each denomination of money, for example, in a register installed in a store or the like. Namely, in the case of operating the banknote recognition and counting machine 10 in this second mixed-denomination deposit mode, in order to collectively count the banknotes P, respectively stored, for each denomination of money, in the register of the store or the like, the operation of this banknote recognition and counting machine 10 can be once stopped, each time the difference or change in the denomination of money is detected, during the counting process for the banknotes P, respectively stacked for each denomination of money.

In the different denomination mode, the plurality of banknotes P are placed, in the stacked condition, on the placing unit 14, and then such banknotes P are fed, one by one, into the casing 12 by the feeding unit 16. During this operation, the banknotes P are recognized and counted by the recognition and counting unit 24. At this time, when the denomination of money of the second or later banknote P that is fed, second or later, into the casing 12 and then recognized by the recognition and counting unit 24 is the same as the denomination of money of the first banknote P that is fed, first, into the casing 12 and then recognized by the recognition and counting unit 24, the counting process for such banknotes P is conducted by the recognition and counting unit 24, and then the so-counted banknotes P are respectively fed to the stacking unit 26. Meanwhile, when the denomination of money of the second or later banknotes P that is fed, second or later, into the casing 12 and then recognized by the recognition and counting unit 24 is different from the denomination of money of the first banknote P that is fed, first, into the casing 12 and then recognized by the recognition and counting unit 24, each banknote different in the denomination of money from the denomination of money of the first banknote P is fed to the reject unit 30, without being counted by the recognition and counting unit 24. Thus, in this banknote recognition and counting unit 10, the number and total amount of money can be calculated, for only the banknotes P of the same denomination of money as the denomination of money of the first banknote that is fed, first, into the casing 12 and then recognized by the recognition and counting unit 24.

In the counting mode, the recognition process on the denomination of money or the like for the banknotes P is not performed, and only the counting process for the banknotes P is performed, by the recognition and counting process 24.

Next, the counting process function will be described. As the counting process function, seven functions, i.e., a batch function, a face/back arrangement function, an orientation arrangement function, a designated-denomination elimination function, a batch integration function, an addition function and a manual-input function, are provided, respectively.

The batch function is used upon performing a batch process for the banknotes P. More specifically, in this batch function, when the aforementioned first mixed-denomination deposit mode or second mixed-denomination deposit mode is used, the counting process for the banknotes P in the banknote recognition and counting machine 10 is once stopped, each time the number of the banknotes P counted by the recognition and counting unit 24 reaches a preset batch number. Further, in the case the first mixed-denomination deposit mode or second mixed-denomination deposit mode is used, the total number of the banknotes over the plurality of denominations of money or number of the banknotes for each denomination of money is set as the batch number.

In this batch function, when the aforementioned different denomination mode is used, the counting process for the banknotes P in the banknote recognition and counting machine 10 is once stopped, each time the number of the banknotes P counted by the recognition and counting unit 24 reaches the preset batch number. However, in the case of using this different denomination mode, the same number of the banknotes over all of the denominations of money, or numbers of the banknotes respectively different for each denomination of money are set as the batch number. Further, in this batch function, when the aforementioned counting mode is used, the counting process for the banknotes P in the banknote recognition and counting machine 10 is once stopped, each time the number of the banknotes P counted by the recognition and counting unit 24 reaches the preset batch number. However, in the case of using this counting mode, only the number of the banknotes is set as the batch number.

The face/back arrangement function is used upon arranging the orientation of the face/back of each banknote P. More specifically, in this face/back arrangement function, the plurality of banknotes P are placed, in the stacked condition, on the placing unit 14, and then such banknotes P are fed, one by one, into the casing 12 by the feeding unit 16. During this operation, the banknotes P are recognized and counted by the recognition and counting unit 24. At this time, when the orientation of the face/back of the second or later banknote P that is fed, second or later, into the casing 12 and then recognized by the recognition and counting unit 24 is the same as the orientation of the face/back of the first banknote P that is fed, first, into the casing 12 and then recognized by the recognition and counting unit 24, such banknotes P are respectively fed to the stacking unit 26. Meanwhile, when the orientation of the face/back of the second or later banknote P that is fed, second or later, into the casing 12 and then recognized by the recognition and counting unit 24 is different from the orientation of the face/back of the first banknote P that is fed, first, into the casing 12 and then recognized by the recognition and counting unit 24, each banknote different in the orientation of the face/back from the orientation of the face/back of the first banknote P is fed to the reject unit 30.

The orientation arrangement function is used upon arranging the orientation of the long edge or short edge of each banknote P. More specifically, in this orientation arrangement function, the plurality of banknotes P are placed, in the stacked condition, on the placing unit 14, and then such banknotes P are fed, one by one, into the casing 12 by the feeding unit 16. During this operation, the banknotes P are recognized and counted by the recognition and counting unit 24. At this time, when the orientation of the long edge or short edge of the second or later banknote P that is fed, second or later, into the casing 12 and then recognized by the recognition and counting unit 24 is the same as the orientation of the long edge or short edge of the first banknote P that is fed, first, into the casing 12 and then recognized by the recognition and counting unit 24, such banknotes P are respectively fed to the stacking unit 26. Meanwhile, when the orientation of the long edge or short edge of the second or later banknote P that is fed, second or later, into the casing 12 and then recognized by the recognition and counting unit 24 is different from the orientation of the long edge or short edge of the first banknote P that is fed, first, into the casing 12 and then recognized by the recognition and counting unit 24, each banknote different in the orientation of the long edge or short edge from the orientation of the long edge or short edge of the first banknote is fed to the reject unit 30.

The designated-denomination elimination function is used upon eliminating each banknote P of the denomination of money that is designated in advance. More specifically, in this designated-denomination elimination function, the plurality of banknotes P are placed, in the stacked condition, on the placing unit 14, and then such banknotes P are fed, one by one, into the casing 12 by the feeding unit 16. During this operation, the banknotes P are recognized and counted by the recognition and counting unit 24. At this time, when the denomination of money of each banknote P recognized by the recognition and counting unit 24 is the same as the denomination of money that is designated in advance, this banknote P is fed to the reject unit 30. Meanwhile, when the denomination of money of each banknote P recognized by the recognition and counting unit 24 is different from the denomination of money that is designated in advance, this banknote P is fed to the stacking unit 26.

The batch integration function is used upon performing the batch process for the banknotes P, when the aforementioned different denomination mode is used. More specifically, in this batch integration function, when the different denomination mode is employed, the counting process for the banknotes P in the banknote recognition and counting machine 10 is once stopped, each time the number of the banknotes P counted by the recognition and counting unit 24 reaches the preset batch number. Then, the count results on the banknotes P for the respective batch processes are integrated together.

The addition function is used for adding each count result to one another, the count result being obtained upon each counting process for the banknotes P performed in the banknote recognition and counting machine 10. Further, the manual input function is implemented by the respective keys 32*b* through 32*m* respectively provided in the operation/display unit 32, and is used for correcting each count result for the banknotes P obtained by the recognition and counting unit 24.

Next, the setting function will be described. This setting function is used when the operator performs various settings, in the operation mode of the banknote recognition and counting machine 10, via the operation/display unit 32. In this setting function, by pushing down each of the SHIFT key 32*b*, C (clear) key 32*d*, MENU key 32*f*, C (clear) key 32*h*, START/STOP keys 32*c*, 32*g*, ACCEPT keys 32*e*, 32*i*, F1 (first function) key 321, F2 (second function) key 32*k*, F3 (third function) key 32*l* and F4 (fourth function) key 32*m*, the operator can perform the various settings. Further, the ACCEPT keys

32*e*, 32*i* and START/STOP keys 32*c*, 32*g* are respectively provided for setting each content selected by using the other keys.

Next, the double-operational function will be described. As used herein, the double-operational function means a function for performing a data management operation for two operators. For instance, when one operator turns ON a double-operational specification via the operation/display unit 32, the double-operational function can be utilized. When the double-operational specification is turned ON, various data, such as counting data on the banknotes P, total data, user setting data, batch setting data and the like, can be used, for the two operators, in the control unit 50. Such data can be readily switched by the key operation in the operation/display unit 32. For instance, when the double-operational function is used, dollar banknotes are assigned to a first operator, while euro banknotes are assigned to a second operator, in the control unit 50. Thus, the data, such as the counting data, total data, user setting data, batch setting data and the like, will be used for each of the dollar banknotes and euro banknotes.

Various patterns are provided for a double-operational operation using the double-operational function.

As a first pattern for the double-operational operation, the double-operational specification is used in a local operation (i.e., an operation in which the banknote recognition and counting machine 10 is solely used, and is hence not connected with the higher-ranking machine, such as the host computer or the like). In this case, the two operators use the operation/display unit 32, separately from each other. For instance, the first operator uses the ACCEPT key 32*e* and START/STOP key 32*c* respectively located on the right side relative to the display unit 32*p*, while the second operator uses the ACCEPT key 32*i* and START/STOP key 32*g* respectively located on the left side relative to the display unit 32*p*. Namely, the ACCEPT key 32*e* and START/STOP key 32*c* constitute together a first operation unit, while the ACCEPT key 32*i* and START/STOP key 32*g* constitute together a second operation unit. Further, when the first operator uses the operation/display unit 32, the RIGHT (right-side) lamp 32*u* is turned on. Meanwhile, when the second operator uses the operation/display unit 32, the LEFT (left-side) lamp 32*w* is turned on.

As a second pattern for the double-operational operation, the double-operational operation is performed by using a local machine (i.e., the banknote recognition and counting machine 10) together with the higher-ranking machine. In this pattern, for instance, the first operator performs the operation, via the operation/display unit 32 of the banknote recognition and counting machine 10, while the second operator performs the operation, via another operation/display unit provided to the higher-ranking machine. In this case, the local machine (i.e., the banknote recognition and counting machine 10) and higher-ranking machine can be set, separately from each other, by user setting. As such, the on-line operation and off-line operation can be smoothly switched relative to each other.

As a third pattern for the double-operational operation, the on-line operation is performed by connecting two higher-ranking machines with the banknote recognition and counting machine 10. Namely, in this pattern, the first and second operators perform the operations, respectively, via each corresponding operation/display unit of the two higher-ranking machines. In this case, the data is transmitted to one higher-ranking machine connected with the banknote recognition and counting machine 10, prior to the other higher-ranking machine.

As a fourth pattern for the double-operational operation, the data on the operations respectively performed by the two operators is printed on one printing unit 34, upon the double-operational operation as described above.

As a fifth pattern for the double-operational operation, two judgment threshold values (i.e., one threshold value for the normal counting process and the other threshold value for a relaxation counting process) are provided to be respectively used for the recognition process for the banknotes P performed by the recognition and counting unit 24. In the double-operational operation of this pattern, for instance, the first operator uses the one judgment threshold value for the normal counting process, while the second operator uses the other judgment threshold value for the relaxation counting process. Further, in this fifth pattern, the two operators use the operation/display unit 32, separately from each other. For instance, the first operator uses the ACCEPT key 32*e* and START/STOP key 32*c* respectively located on the right side relative to the display unit 32*p*, while the second operator uses the ACCEPT key 32*i* and START/STOP key 32*g* respectively located on the left side relative to the display unit 32*p*. It is noted that this fifth pattern for the double-operational operation will be further described later.

Now, one characteristic operation of the banknote recognition and counting machine 10 of this embodiment will be described. In this characteristic operation of the banknote recognition and counting machine 10, the normal counting process for the banknotes P is first performed, and then the relaxation counting process for the banknote P', respectively fed to the reject unit 30 upon the normal counting process for the banknotes P, is performed, with the level of the authenticity judgment or denomination judgment being lowered as compared with that level in the normal counting process.

In brief, in the above characteristic operation of the banknote recognition and counting machine 10 of this embodiment, the banknotes P are first put into the casing 12, and then recognized and counted by the recognition and counting unit 24. Thereafter, each banknote P is judged, by using the first judgment threshold value, based on the recognition result on this banknote P recognized by the recognition and counting unit 24, and then selectively fed to either one of the stacking unit 26 or reject unit 30, based on the judgment result on this banknote P. Thereafter, the banknotes P, respectively fed to the reject unit 30, are placed on the placing unit 14, and then put again into the casing 12. Subsequently, the recognition and counting process for such banknotes P, respectively put again into the casing 12, is performed by the recognition and counting unit 24. Thereafter, based on the recognition result on each banknote P recognized by the recognition and counting unit 24, the banknote P is judged, by using the second judgment threshold value set smaller than the first judgment threshold value. Then, the control unit 50 outputs information concerning the total sum of the count result on the banknotes P, respectively judged to be true upon the judgment for the banknotes P performed by using the first judgment threshold value, and the count result for the banknotes P, respectively judged to be true upon the judgment for the banknotes P performed by using the second judgment threshold value. In this case, the mode in which the judgment for the banknotes P is performed by using the first judgment threshold value is referred to as the normal counting mode, while the mode in which the judgment for the banknotes P is performed by using the second judgment threshold value that is set smaller than the first judgment threshold value is referred to as the relaxation counting mode.

First, in the characteristic operation of the banknote recognition and counting machine 10 as described above, the details of the first judgment threshold value and second judgment threshold value will be described, with reference to FIG. 7. Namely, as the first judgment threshold value and second judgment threshold value, as shown in FIG. 7, the judgment threshold values used for the denomination judgment for the banknotes P (i.e., the denomination judgment threshold values) and the judgment threshold values used for the authenticity judgment for the banknotes P (i.e., the authenticity judgment threshold values) are provided, respectively. Further, such first judgment threshold values, respectively used for the denomination judgment and authenticity judgment, are provided in a plural of numbers, respectively corresponding to the sensors respectively constituting the recognition and counting unit 24. For instance, the threshold value shown in a column of "IR1" in FIG. 7 indicates the judgment threshold value compared with the detection value IR1 calculated by the line sensor 24*b*. Similarly, the threshold value shown in a column of "IR2" in FIG. 7 denotes the judgment threshold value compared with the detection value IR2 calculated by the line sensor 24*b*, and the threshold value in a column of "MG1" in FIG. 7 indicates the judgment threshold value compared with the detection value MG1 calculated by the magnetic array MG1.

Further, in this case, the second judgment threshold values are respectively changed or altered, corresponding to each mode used in the aforementioned counting mode function. For instance, as shown in FIG. 7, when the mixed-denomination deposit mode (i.e., the first-mixed denomination deposit mode or second mixed-denomination deposit mode) or different denomination deposit mode is used, each second judgment threshold value is set at zero (0), in both of the threshold values used for the denomination judgment for the banknotes P (i.e., the denomination judgment threshold values) and the threshold values used for the authenticity judgment for the banknotes P (i.e., the authenticity judgment threshold values). In the case each second judgment threshold value is set at 0, when the recognition process for the banknotes P is performed by the recognition and counting unit 24 by using this second judgment threshold value, all of the banknotes P other than the transport-error banknotes are judged to be true, and thus fed to the stacking unit 26. Further, in the case each second judgment threshold value is set at 0, each judgment process may be skipped. Meanwhile, in the case the mixed-denomination deposit mode or different denomination deposit mode is not used, each second judgment threshold value is set at a value smaller, e.g., a half, relative to each corresponding first judgment threshold value, in both of the threshold values used for the denomination judgment for the banknotes P (i.e., the denomination judgment threshold values) and the threshold values used for the authenticity judgment for the banknotes P (i.e., the authenticity judgment threshold values). With the provision of each second judgment threshold value set smaller than each corresponding first judgment threshold value, the level of the authenticity judgment or denomination judgment for the banknotes P is lowered to some extent. Namely, the relaxation counting mode of this embodiment is intended for providing some possibility of being judged to be true to even such a banknote P that is not judged to be true in the normal counting mode.

Further, in the control unit 50 of the banknote recognition and counting machine 10, a transaction counter and a total counter are provided, respectively. Now, such transaction counter and total counter will be described. In an initial state, the transaction counter and total counter are set at zero (0), respectively. However, the transaction counter is incremented, by one, each time one banknote P is counted by the recognition and counting unit 24, during the counting process for the banknotes P in the banknote recognition and counting machine 10. The total counter is provided for totalizing respective transaction counters used for a plurality of transactions. In this case, a plurality of transaction counters are provided, respectively corresponding to the denominations of money, respectively related. Further, the transaction counters are provided, respectively corresponding to the first judgment threshold value and second judgment threshold value. For instance, upon the recognition process for the banknotes P performed by the recognition and counting unit 24 by using the first judgment threshold value, when the banknotes P are one (1) dollar banknotes, the transaction counter provided for the 1 dollar banknotes and corresponding to the first judgment threshold value is incremented by one. Similarly, a plurality of total counters are provided, respectively corresponding to the denominations of money, respectively related. Further, the total counters are provided, respectively corresponding to the first judgment threshold value and second judgment threshold value.

The flow chart of FIG. 10 illustrates the transaction-ending process performed in the banknote recognition and counting machine 10 shown in FIG. 1 and so on. In this case, when the operator inputs a command for performing the transaction-ending process to the control unit 50 via the operation/display unit 32, the transaction counter corresponding to the first judgment threshold value is first added to the total counter corresponding to the first judgment threshold value (STEP 1). Then, the transaction counter corresponding to the second judgment threshold value is added to the total counter corresponding to the second judgment threshold value (STEP 2). Thereafter, the transaction counter corresponding to the first judgment threshold value is cleared, and set at zero (0) (i.e., the value of the initial state) (STEP 3). Further, the transaction counter corresponding to the second judgment threshold value is cleared, and set at zero (0) (i.e., the value of the initial state) (STEP 4). In this way, once the transaction-ending process is performed, each transaction counter for one transaction is added to the total counter, for each denomination of money as well as for each judgment threshold value. Thereafter, each transaction counter, for each denomination of money as well as for each judgment threshold value, is cleared and set at zero (0) of the initial state.

The flow chart of FIG. 11 illustrates the total clear process in the banknote recognition and counting machine 10 shown in FIG. 1 and so on. In this case, when the operator inputs a command for performing the total clear process to the control unit 50 via the operation/display unit 32, the total counter corresponding to the first judgment threshold value is cleared and set at zero (0) of the initial state (STEP 1). Further, the total counter corresponding to the second threshold value is cleared and set at zero (0) of the initial state (STEP 2). In this way, once the total clear process is performed, the total counter is cleared and set at zero (0) of the initial state, for each denomination of money as well as for each judgment threshold value.

Now, with reference to the flow charts respectively shown in FIGS. 8 and 9, the characteristic operation of the banknote recognition and counting machine 10 of this embodiment will be described in more detail.

For one transaction, the operator first places the banknotes P to be respectively counted, in the stacked condition, on the placing unit 14. Thereafter, the operator inputs a command for starting the counting process for the banknotes P to the control unit 50, by using the START/STOP keys 32*c* or 32*g* of the operation/display unit 32. At a point of time on which the counting process for the banknotes P is started, both of the transaction counter corresponding to the first judgment threshold value and the transaction counter corresponding to the second judgment threshold value are set at zero (0) of the initial state ("YES" in the STEP 1). Therefore, the normal counting mode using the first judgment threshold value is set as the process mode (STEP 6). Thereafter, the banknotes P respectively placed, in the stacked condition, on the placing unit 14, are fed to the transport unit 22 in the casing 12, one by one, successively, from the banknote P located at the lowermost layer, by the feeding unit 16, and then transported by the transport unit 22 (STEP 8). During this operation, the recognition and counting process for the banknotes P is performed by the recognition and counting unit 24 (STEP 9). At this time, since the process mode is the normal counting mode ("YES" in the STEP 10), the control unit 50 judges each banknote P, by using the first judgment threshold value, based on the recognition result on this banknote P recognized by the recognition and counting unit 24 (STEP 11). In this case, the control unit 50 performs either one of the authenticity judgment or denomination judgment, or both thereof, for each banknote P. As a result, if the banknote P is judged to be true by the control unit 50 ("YES" in the STEP 13), this banknote P is fed to the stacking unit 26 by the transport unit 22, and then stacked in the stacking unit 26 (STEP 14). In this case, since the first judgment threshold value is used as the judgment threshold value ("YES" in the STEP 16), the transaction counter corresponding to the first judgment threshold value and related to the denomination of money of the judged banknote P is incremented by one (STEP 17). Meanwhile, if the banknote P is not judged to be true by the control unit 50 ("NO" in the STEP 13), this banknote P' is fed to the reject unit 30 by the transport unit 22 (STEP 15). In this manner, until there is no banknote P remaining on the placing unit 14, this operation is repeated ("NO" in the STEP 19). Thereafter, when all of the banknotes P placed in the stacked condition on the placing unit 14 are fed into the casing 12 and thus there is no banknote P remaining on the placing unit 14 ("YES" in the STEP 19), the control unit 50 outputs the total sum of the transaction counter corresponding to the first judgment threshold value and the transaction counter corresponding to the second judgment threshold value (STEP 20). In this case, since the transaction counter corresponding to the second judgment threshold value and related to each denomination of money is set at zero (0), the control unit 50 outputs, virtually, only the transaction counter corresponding to the first judgment threshold value and related to each denomination of money. Thereafter, a recounting process for the banknotes P is performed as described below.

Upon performing the recounting process for the banknotes P, the operator places the banknotes P', respectively fed to the reject unit 30 upon the normal counting mode, in the stacked condition, on the placing unit 14. In this case, due to the aforementioned normal counting mode, the transaction counter corresponding to the first judgment threshold value is no longer set at zero (0) ("NO" in the STEP 1). Therefore, for each of the banknotes P', respectively fed to the reject unit 30 upon the normal counting mode, whether or not this banknote P' is the banknote that has not been judged to be true, because of abnormality in the denomination of money and/or abnormality in the authenticity, is judged. As a result, if the banknote P' fed from the reject unit 30 in the previous counting process is the banknote that has not been judged to be true, because of the abnormality in the denomination of money and/or abnormality in the authenticity ("YES" in the STEP 2), some guidance for performing the counting process for the banknotes P in the relaxation counting mode is displayed on the display unit 32*p* in the operation/display unit 32 (STEP 3). Meanwhile, if some banknotes, other than the banknote that has not been judged to be true, because of the abnormality in the denomination of money and/or abnormality in the authenticity, are included in the banknotes P', respectively fed to the reject unit 30 upon the normal counting mode ("NO" in the STEP 2), more specifically if some banknotes that have not been judged to be true, because of, for example, the transport error, are included in the banknotes P, another guidance for performing the counting process for the banknotes P in the normal counting mode is displayed on the display unit 32*p* in the operation/display unit 32 (STEP 4). In either case, the display of such guidance on the display unit 32*p* in the operation/display unit 32 may be a display of some message, or otherwise may be a color display of an LED or the like. Thereafter, the banknote recognition and counting machine 10 will be in a state for waiting a mode-selection input (STEP 5*a*). In this state, upon the recounting process for the banknotes P, the operator inputs a command for performing the normal counting mode or relaxation counting mode, to the control unit 50 (STEP 5*b*).

Otherwise, the control unit 50 may serve to automatically select either one of the two counting modes instead the aforementioned guidance is displayed on the display unit 32*p* in the operation/display unit 32 and the operator inputs the command for performing either one of the above two counting modes to the control unit 50 via the operation/display unit 32. More specifically, in the case all of the banknotes P' fed to the reject unit 30 in the normal counting mode are such banknotes that have not been judged to be true because of the abnormality in the denomination of money and/or abnormality in the authenticity, the relaxation counting mode is automatically set as the process mode for recounting the banknotes P. Meanwhile, in the case some banknotes other than the banknotes that have not been judged to be true because of the abnormality in the denomination of money and/or abnormality in the authenticity are included in the banknotes P' fed to the reject unit 30 in the normal counting mode, more specifically in the case the banknotes that have not been judged to be true because of, for example, the transport error, are included in the banknotes P', the normal counting mode is automatically selected as the process mode for recounting the banknotes P.

For instance, if the normal counting mode is set as the process mode, by the operator or automatically (STEP 6), the recounting process for the banknotes P is performed by using the first judgment threshold value. Because the procedure for performing the recounting process for the banknotes P by using the first judgment threshold value is substantially the same as the flow of the aforementioned operation, the explanation on this recounting process is now omitted. Meanwhile, even if the relaxation counting mode is set as the process mode, by the operator or automatically (STEP 7), the banknotes P respectively placed in the stacked condition on the placing unit 14 are fed to the transport unit 22 in the casing 12, by the feeding unit 16, one by one, successively, from the banknote P located at the lowermost layer, and then transported by the transport unit 22 (STEP 8). During this operation, the banknotes P are recognized and counted by the recognition and counting unit 24 (STEP 9). In this case, since the counting mode for the banknotes P is set as the relaxation counting mode ("NO" in the STEP 10), the control unit 50 performs the judgment for the banknotes P, by using the second judgment threshold value, based on the recognition result on each banknote P recognized by the recognition and counting unit 24 (STEP 12).

In this operation, as shown in FIG. 7, when the first mixed-denomination deposit mode, second mixed-denomination deposit mode or different denomination mode is used as one mode in the counting mode function, each second judgment threshold value is set at zero (0). In this case, the banknotes P other than the transport-error banknotes P are all judged to be true, and hence fed to the stacking unit 26. At this time, since the second judgment threshold value is used as the judgment threshold value ("NO" in the STEP 16), the transaction counter corresponding to the second judgment threshold value and related to the denomination of money of the banknotes P is incremented by one (1) (STEP 18). Meanwhile, when the first mixed-denomination deposit mode, second mixed-denomination deposit mode or different denomination mode is not used as the mode in the counting mode function, the control unit 50 performs the judgment for the banknotes P, by using each second judgment threshold value, based on the recognition result on each banknote P recognized by the recognition and counting unit 24 (STEP 12). More specifically, the control unit 50 performs either one of the authenticity judgment or denomination judgment, or both thereof, for each banknote P. In this case, if the banknotes P are respectively judged to be true by the control unit 50 ("YES" in the STEP 13), such banknotes P are fed to the stacking unit 26 by the transport unit 22, and stacked in the stacking unit 26 (STEP 14). In this case, since the second judgment threshold value is set as the judgment threshold value ("NO" in the STEP 16), the transaction counter corresponding to the second judgment threshold value and related to the denomination of money of the banknotes P is incremented by 1 (STEP 18). Meanwhile, if the banknotes P are not respectively judged to be true by the control unit 50 ("NO" in the STEP 13), such banknotes P' are fed again to the reject unit 30 by the transport unit 22 (STEP 15). In this manner, until there is no banknote P remaining on the placing unit 14, the operation as described above will be repeated ("NO" in the STEP 19). Thereafter, when all of the banknotes P, respectively placed in the stacked condition on the placing unit 14, are fed into the casing 12 and thus there is no banknote P remaining on the placing unit 14 ("YES" in the STEP 19), the control unit 50 outputs the total sum of the transaction counter corresponding to the first judgment threshold value and the transaction counter corresponding to the second judgment threshold value (STEP 20).

Once the control unit 50 outputs the total sum of the transaction counter corresponding to the first judgment threshold value and the transaction counter corresponding to the second judgment threshold value, this total sum of such transaction counters is displayed on the display unit 32*p* of the operation/display unit 32. Alternatively, the total sum of the transaction counters may be printed by the printing unit 34 composed of, for example, the printer. Alternatively, the total sum of the transaction counters may be stored in the memory unit 36. In the case the total sum of the transaction counters is outputted by the control unit 50 and then displayed on the display unit 32*p* of the operation/display unit 32 or printed by the printing unit 34, the information concerning the number of the banknotes for each denomination of money may be displayed or printed, for the total sum of the transaction counters, and/or the information concerning the amount of money of the banknotes may be displayed or printed, for the total sum of the transaction counters.

Further, in the case the total sum of the transaction counters is outputted by the control unit 50 and then displayed on the display unit 32*p* of the operation/display unit 32 or printed by the printing unit 34, the information for indicating which of the first or second judgment threshold value is used, in each transaction counter, upon performing the judgment for the banknotes, may be displayed or printed, in addition to the information concerning the total sum of the transaction counters. In this case, the information concerning the total amount of money and/or information concerning the number of the banknotes for each denomination of money may be displayed or printed, for each transaction counter.

FIGS. 12(*a*) through 12(*c*) are provided for respectively illustrating various examples of the information outputted from the control unit 50. FIG. 12(*a*) shows the information outputted from the control unit 50, in which the information includes: the total amount of money of the count result on the banknotes P respectively judged to be true upon the judgment for the banknotes P by using the first judgment threshold value (i.e., the total amount of money in the normal counting mode: $1,153); the total amount of money of the count result on the banknotes P respectively judged to be true upon the judgment for the banknotes P by using the second judgment threshold value (i.e., the total amount of money in the relaxation counting mode: $6); and the total amount of money of the count results on the banknotes P of the above two modes ($1,159). FIG. 12(*b*) shows the information outputted from the control unit 50 and including: the number of the banknotes P for each denomination of money (see each column of "BILL" shown in FIG. 12(*b*)) and the total amount of money of the banknotes P ($1,159), in the total sum of the count result on the banknotes P respectively judged to be true upon the judgment for the banknotes P by using the first judgment threshold value and the count result on the banknotes P respectively judged to be true upon the judgment for the banknotes P by using the second judgment threshold value; the total amount of money of the count result on the banknotes P respectively judged to be true upon the judgment for the banknotes P by using the first judgment threshold value (i.e., the total amount of money in the normal counting mode: $1,153); and the total amount of money of the count result on the banknotes P respectively judged to be true upon the judgment for the banknotes P by using the second judgment threshold value (i.e., the total amount of money in the relaxation counting mode: $6), as the details of the total amount of money of the banknotes P.

FIG. 12(*c*) shows the information outputted from the control unit 50 and including: the total amount of money (see "$1,159" corresponding to a column of "DEPOSIT total AMOUNT") calculated as the total sum of the count result on the banknotes P respectively judged to be true upon the judgment for the banknotes P by using the first judgment threshold value and the count result on the banknotes P respectively judged to be true upon the judgment for the banknotes P by using the second judgment threshold value; the number of the banknotes P for each denomination of money (see one "BILL" under the "NORMAL COUNTING MODE") of the count result on the banknotes P respectively judged to be true upon the judgment for the banknotes P by using the first judgment threshold value; and the number of the banknotes for each denomination of money (see another "BILL" under the "NORMAL COUNTING MODE") of the count result on the banknotes P respectively judged to be true upon the judgment for the banknotes P by using the second judgment threshold value.

The information respectively shown in FIGS. 12(*a*) through 12(*c*) may be displayed on the display unit 32*p* of the operation/display unit 32 and/or printed by the printing unit 34 composed of, for example, the printer. Alternatively, the information respectively shown in FIGS. 12(*a*) through 12(*c*) may be stored in the memory unit 36. Further, the information outputted from the output unit 50 is not limited to each aspect as shown in FIGS. 12(*a*) through 12(*c*). For instance, a proper combination or combinations of items of the information respectively shown in FIGS. 12(*a*) through 12(*c*), and/or only a part of the information respectively shown in FIGS. 12(*a*) through 12(*c*) may be outputted from the control unit 50.

Alternatively, further information than the information respectively shown in FIGS. 12(*a*) through 12(*c*) may be outputted from the control unit 50.

In this manner, when the control unit 50 outputs the information concerning the total sum of the count result on the banknotes P respectively judged to be true upon the judgment for the banknotes P by using the first judgment threshold value and the count result on the banknotes P respectively judged to be true upon the judgment for the banknotes P by using the second judgment threshold value, the information concerning the total amount of money in the total sum may be outputted, or the information concerning the total number of the banknotes for each denomination of money in the total sum may be outputted, or otherwise both of such information may be outputted. Further, for each of the count result on the banknote P respectively judged to be true upon the judgment for the banknotes P by using the first judgment threshold value and the count result on the banknotes P respectively judged to be true upon the judgment for the banknotes P by using the second judgment threshold value, the control unit 50 may output the information concerning the total amount of money, or output the information concerning the total number of the banknotes for each denomination of money, or otherwise output the information concerning both of such information.

Next, the case, in which the aforementioned double-operational function is used upon the characteristic operation of the banknote recognition and counting machine 10 as shown in the flow charts of FIGS. 8 and 9, will be described.

When the operator turns ON the double-operational specification via the operation/display unit 32, the data management operation for the two operators is performed as described above. For instance, in this operation, the transaction counter corresponding to the first judgment threshold value is assigned to the first operator, while the transaction counter corresponding to the second judgment threshold value is assigned to the second operator. In this case, the two operators use the operation/display unit 32, separately from each other. For instance, the first operator uses the ACCEPT key 32*e* and START/STOP key 32*c* respectively located on the right side relative to the display unit 32*p*, while the second operator uses the ACCEPT key 32*i* and START/STOP key 32*g* respectively located on the left side relative to the display unit 32*p*.

In the case of performing the characteristic operation of the banknote recognition and counting machine 10 by using the double-operational function, the first operator puts the banknotes P into the casing 12, in order to perform the recognition and counting process for the banknotes P by using the recognition and counting unit 24. Then, the judgment for the banknotes P is performed by using the first judgment threshold value, based on the recognition result on each banknote P recognized by the recognition and counting unit 24, and then the banknotes P are fed, selectively, to the stacking unit 26 or reject unit 30, based on the judgment result on each banknote P. At this time, the transaction counter for the banknotes P corresponding to the first judgment threshold value is used for the first operator. Thus, the normal counting mode is performed by this first operator.

Thereafter, the second operator places the banknotes P, respectively fed to the reject unit 30, on the placing unit 14, and then put again such banknotes P, respectively placed on the placing unit 14, into the casing 12. Thereafter, the recognition and counting process for the banknotes P, respectively put again into the casing 12, is performed by the recognition and counting unit 24. Subsequently, the judgment for the banknotes P is performed, by using the second judgment threshold value set smaller than the first judgment threshold value. In this case, the transaction counter for the banknotes P corresponding to the second judgment threshold value is operated for the second operator. Thus, the relaxation counting mode is performed by this second operator. Thereafter, the control unit 50 outputs the information concerning the total sum of the transaction counter corresponding to the first judgment threshold value and the transaction counter corresponding to the second judgment threshold value. In this case, when the information outputted from the control unit 50 is stored in the memory unit 36, the information on the transaction counter corresponding to the first judgment threshold value and the information on the transaction counter corresponding to the second judgment threshold value are stored, separately from each other, in different areas of the memory unit 36.

As stated above, according to the banknote recognition and counting machine 10 of this embodiment, the control unit 50 serves to receive the recognition result on each banknote P sent from the recognition and counting unit 24, judge each banknote P on the basis of the recognition result thereof, and then control the transport unit 22 to feed the banknotes P, respectively judged to be true, to the stacking unit 26, as well as to feed the banknotes P, not respectively judged to be true, to the reject unit 30. In this case, upon the judgment for the banknotes P, the control unit 50 uses either one of the first judgment threshold value and second judgment threshold value set smaller than the first judgment threshold value. More specifically, the control unit 50 first performs the judgment for the banknotes P, by using the first judgment threshold value (i.e., in the normal counting mode), and then performs the judgment for the banknotes P, respectively fed to the reject unit 30 upon the judgment using the first judgment threshold value, by using the second judgment threshold value (i.e., in the relaxation counting mode). Thereafter, the control unit 50 outputs the information concerning the total sum of the transaction counter (or count result) for the banknotes P, respectively judged to be true upon the judgment for the banknotes P by using the first judgment threshold value and the transaction counter (or count result) for the banknotes P, respectively judged to be true upon the judgment for the banknotes P by using the second judgment threshold value.

Further, according to the banknote recognition and counting method related to the above embodiment, the banknotes P are put into the banknote recognition and counting machine 10, and the recognition and counting process for the banknotes P is performed by the recognition and counting unit 24, and then the judgment for the banknotes P is performed, by using the first judgment threshold value (i.e., in the normal counting mode), based on the recognition result on each banknote P recognized by the recognition and counting unit 24, and thereafter each banknote P judged to be true is fed to the stacking unit 26, while each banknote P not judged to be true is fed to the reject unit 30, based on each judgment result on such banknotes. Thereafter, the banknotes P', respectively fed to the reject unit, 30 are put again into the banknote recognition and counting machine 10, and the recognition and counting process for such banknotes P is performed by the recognition and counting unit 24, and then the judgment for the banknotes P is performed, by using the second judgment threshold value set smaller than the first judgment threshold value (i.e., in the relaxation counting mode), based on the recognition result on each banknote P recognized by the recognition and counting unit 24. Thereafter, the information, concerning the total sum of the transaction counter (or count result) for the banknotes P, respectively judged to be true upon the judgment for the banknotes P by using the first judgment threshold value and the transaction counter (or count result) for the banknotes P, respectively judged to be true upon the judgment for the banknotes P by using the second judgment threshold value, is outputted.

According to the above banknote recognition and counting machine 10 and banknote recognition and counting method, since the information, concerning the total sum of the transaction counter (or counter result) for the banknotes P, respectively judged to be true upon the judgment for the banknotes P by using the first judgment threshold value (i.e., in the normal counting mode) and the transaction counter (or counter result) for the banknotes P, respectively judged to be true upon the judgment for the banknotes P by using the second judgment threshold value (i.e., in the relaxation counting mode), is outputted, the need for inputting the count result on the banknotes P, by manual input or the like means, can be eliminated, upon performing the authenticity judgment and/or denomination judgment for the banknotes P. As such, this banknote recognition and counting machine 10 and banknote recognition and counting method can respectively provide a significantly simplified operation for recognizing and counting the banknotes. Further, since the information concerning the total sum of the transaction counter for the banknotes P, respectively judged to be true upon the judgment for the banknotes P by using the first judgment threshold value and the transaction counter for the banknotes P, respectively judged to be true upon the judgment for the banknotes P by using the second judgment threshold value, is outputted, the operator can readily recognize the information on the total sum of the transaction counters for the banknotes P, respectively judged to be true, in both of the judgment modes, i.e., the judgment mode using the first judgment threshold value and the judgment mode using the second judgment threshold value.

Additionally, in the banknote recognition and counting machine 10 of this embodiment, in the case the control unit 50 performs only the authenticity judgment for the banknotes P, based on the recognition result on each banknote P sent from the recognition and counting unit 24, the first judgment threshold value and second judgment threshold value are respectively used as the authenticity judgment threshold value. In this case, the control unit 50 controls the transport unit 22 to transport the banknotes P, respectively judged to be genuine upon the authenticity judgment for the banknotes P, as the banknotes P, each being true, to the stacking unit 26, as well as to transport the banknotes P, not respectively judged to be genuine, as the banknotes P', each being not true, to the reject unit 30. Further, in the case the control unit 50 performs only the denomination judgment for the banknotes P, based on the recognition result on each banknote P sent from the recognition and counting unit 24, the first judgment threshold value and second judgment threshold value are respectively used as the denomination judgment threshold value. In this case, the control unit 50 controls the transport unit 22 to transport the banknotes P, the denomination of money of which is judged upon the denomination judgment for the banknotes P, as the banknotes P, each being true, to the stacking unit 26, as well as to transport the banknotes P, the denomination of money of which is not judged, as the banknotes P', each being not true, to the reject unit 30. Further, in the case the control unit 50 performs both of the authenticity judgment and denomination judgment for the banknotes P, based on the recognition result on each banknote P sent from the recognition and counting unit 24, both of the authenticity judgment threshold value and denomination judgment threshold value are used, as the first judgment threshold value and second judgment threshold value, respectively. In this case, the control unit 50 controls the transport unit 22 to transport each banknote P, which is judged as an genuine banknote in the authenticity judgment for the banknotes P, and the denomination of money of which is judged upon the denomination judgment for the banknotes P, as the banknotes P, each being true, to the stacking unit 26, as well as to transport each banknote P other than such true banknotes, (e.g., each banknote P not judged as an genuine banknote upon the authenticity judgment and/or each banknote P, the denomination of money of which is not judged upon the denomination judgment), as the banknotes P', each being not true, to the reject unit 30.

Further, in the banknote recognition and counting machine 10 of this embodiment, the control unit 50 serves to output the information concerning the total amount of money (see FIG. 12(*a*) through 12(*c*)) and/or information concerning the total number of the banknotes for each denomination of money (see FIG. 12(*b*)), in the total sum of the count result on the banknotes P, respectively judged to be true upon the judgment for the banknotes P by using the first judgment threshold value, and the count result on the banknotes P, respectively judged to be true upon the judgment for the banknotes P by using the second judgment threshold value.

Further, in the banknote recognition and counting machine 10 of this embodiment, a plurality of operation units are provided for respectively inputting the command to the control unit 50. More specifically, in the banknote recognition and counting machine 10, the two operators use the operation/display unit 32, separately from each other, upon the double-operational operation. Namely, in this operation/display unit 32, the first operation unit composed of the ACCEPT key 32*e* and START/STOP key 32*c*, and the second operation unit composed of the ACCEPT key 32*i* and START/STOP key 32*g* are provided, respectively. Thus, for instance, the first operator uses the first operation unit, while the second operator uses the second operation unit. Further, in this case, the first operator performs the judgment for the banknotes P, by using the first judgment threshold value (or in the normal counting mode), via the first operation/display unit, while the second operator performs the judgment for the banknotes P, by using the second judgment threshold value (or in the relaxation counting mode), via the second operation/display unit.

Additionally, in the banknote recognition and counting machine 10 of this embodiment, the control unit 50 serves to output the information for indicating which of the first or second judgment threshold value is used, in each transaction counter, upon performing the judgment for the banknotes P, in addition to the information concerning the total sum of the transaction counters (or count results). More specifically, in regard to the information outputted from the control unit 50, as shown in FIGS. 12(*a*) through 12(*c*), the information related to the normal counting mode indicates that the judgment for the banknotes P is performed by using the first judgment threshold value, while the information related to the relaxation counting mode indicates that the judgment for the banknotes P is performed by using the second judgment threshold value. In this case, the control unit 50 serves to output the information concerning the total amount of money (see FIGS. 12(*a*) and 12(*b*)) and/or information concerning the number of the banknotes for each denomination of money (see FIG. 12(C)), for each count result.

In addition, in the banknote recognition and counting machine 10 of this embodiment, the display unit 32*p* adapted for displaying the information concerning the total sum of the count results and/or printing unit 34, such as the printer or the like, adapted for printing the information concerning the total sum of the count results is provided. Further, the memory unit 36 adapted for storing therein the information concerning the total sum of the count results is provided.

Additionally, in the banknote recognition and counting machine 10 of this embodiment, after the judgment for the banknotes P is performed by using the first judgment threshold value, some guidance for annunciating whether the judgment is to be performed, for the banknotes P, respectively fed to the reject unit 30, by using again the first judgment threshold value (or in the normal counting mode), or by using the second judgment threshold value (or in the relaxation counting mode), is displayed on, for example, the display unit 32*p* of the operation/display unit 32 (see the STEPS 3, 4 of FIG. 8). However, the method for such annunciation is not limited to the display on such guidance on the display unit 32*p* of the operation/display unit 32. For instance, this annunciation may be performed by a voice.

More specifically, in the case the banknotes P fed to the reject unit 30 are respectively rejected for the transport error, the annunciation of performing the judgment, by using again the first judgment threshold value (i.e., in the normal counting mode), is presented by the guidance display on the display unit 32*p* (see the STEP 4 of FIG. 8). Meanwhile, in the case the banknotes P fed to the reject unit 30 are respectively rejected for the abnormality in the authenticity or abnormality in the denomination of money, the annunciation of performing the judgment, by using the second judgment threshold value (i.e., in the relaxation counting mode), is presented by the guidance display on the display unit 32*p* (see the STEP 3 of FIG. 8).

Further, in the banknote recognition and counting machine 10 of this embodiment, when the banknotes P, respectively fed to the reject unit 30 after the judgment for the banknotes P by using the first judgment threshold value, are judged to be further judged by using the second judgment threshold value, or when all of the banknotes P', respectively fed to the reject unit 30 in the normal counting mode, are the banknotes not respectively judged to be true because of the abnormality in the denomination of money or abnormality in the authenticity, the control unit 50 will automatically perform the judgment for the banknotes P, by using the second judgment threshold value (i.e., in the relaxation counting mode).

Further, for the banknotes P respectively fed to the reject unit 30, the control unit 50 can serve to selectively perform such a process mode as performing only the counting process by using the recognition and counting unit 24. More specifically, in the case the different denomination mode or first mixed-denomination deposit mode is used, as shown in FIG. 7, each second judgment threshold value is set at zero (0), in both of the case in which this value is used for the denomination judgment for the banknotes P (or used as the denomination judgment threshold value) and the case in which this value is used for the authenticity judgment for the banknotes P (or used as the authenticity judgment threshold value). In this case, the recognition process for the banknotes P is not performed by the recognition and counting unit 24, and only the counting process for the banknotes P is performed, virtually. Further, in the case the different denomination mode or first mixed-denomination deposit mode is used, and in which the counting process is performed by the recognition and counting unit 24, all of the banknotes P, except for the transport-error banknotes P, are fed to the stacking unit 26.

What is claimed is:

1. A banknote handling apparatus comprising:

a reception unit configured to take a banknote, that is put therein, into a banknote recognition and counting machine;

a first and second stacking unit configured to stack therein the banknote;

a transport unit configured to selectively transport the banknote taken in by the reception unit, to the first or second stacking unit;

a recognition and counting unit provided to the transport unit and configured to recognize and count the banknote taken in by the reception unit; and a control unit configured to receive a recognition result on each banknote sent from the recognition and counting unit, and control the transport unit to feed each banknote to the first or second stacking unit based on the recognition result, wherein the control unit is configured to first perform a first process by a first process mode to send a banknote to the first or second stacking unit, and then perform a second process by a second process mode to a banknote sent to the first or second stacking unit as a result of the first process mode, and thereafter output information of the process results by the first and second process mode, and wherein the control unit is configured to further output information as to whether each process result is a process result of a banknote having been processed by first or second process mode, in addition to the information of respective process results.

2. The banknote handling apparatus according to claim 1 wherein the second stacking unit is a reject unit in which each banknote judged to be a reject banknote is stacked.

3. The banknote handling apparatus according to claim 1 wherein the control unit is configured to respectively output information of a banknote sent to the first stacking unit by the first process mode and information of a banknote sent to the first stacking unit by the second process mode.

4. The banknote handling apparatus according to claim 3 wherein the control unit is configured to further output combined information of the information of a banknote sent to the first stacking unit by the first process mode and the information of a banknote sent to the first stacking unit by the second process mode.

5. The banknote handling apparatus according to claim 1 wherein the information of respective process results includes a total number of the banknote sent to the first stacking unit by the first process mode and a total number of the banknote sent to the first stacking unit by the second process mode.

6. The banknote handling apparatus according to claim 1 wherein the information of respective process results includes a total amount of money of the banknote sent to the first stacking unit by the first process mode and a total amount of money of the banknote sent to the first stacking unit by the second process mode.

7. The banknote handling apparatus according to claim 1 wherein the information of respective process results includes a number of each denomination of the banknote sent to the first stacking unit by the first process mode and a number of each denomination of the banknote sent to the first stacking unit by the second process mode.

8. The banknote handling apparatus according to claim 1, further comprising a display unit configured to display the information of respective process results.

9. The banknote handling apparatus according to claim 1, further comprising a printing unit configured to print the information of respective process results.

10. The banknote handling apparatus according to claim 1, further comprising a memory unit configured to store therein the information of respective process results.

11. A banknote recognition and counting method comprising:

taking a banknote into a banknote recognition and counting machine, recognizing and counting the banknote by a recognition and counting unit, and based on a recognition result on the banknote by the recognition and counting unit, performing a first process by a first process mode;

taking again the banknote, sent to a first or second stacking unit as a result of the first process mode, into the banknote recognition and counting machine, recognizing and counting the banknote by the recognition and counting unit, and performing a second process by a second process mode based on the recognition result by the recognition and counting unit;

outputting information of the process results by the first and second process mode; and also outputting information as to whether each process result is a process result of a banknote having been processed by first or second process mode.

* * * * *